US010451299B2

(12) United States Patent
Morikawa et al.

(10) Patent No.: US 10,451,299 B2
(45) Date of Patent: Oct. 22, 2019

(54) HUMIDIFIER AND AIR-CONDITIONING APPARATUS INCLUDING HUMIDIFIER

(71) Applicant: Mitsubishi Electric Corporation, Chiyoda-ku (JP)

(72) Inventors: Akira Morikawa, Chiyoda-ku (JP); Takahiro Sakai, Chiyoda-ku (JP); Yasutaka Inanaga, Chiyoda-ku (JP); Kazuya Michikami, Chiyoda-ku (JP); Masaru Takada, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 387 days.

(21) Appl. No.: 15/309,608

(22) PCT Filed: May 9, 2014

(86) PCT No.: PCT/JP2014/062528
§ 371 (c)(1),
(2) Date: Nov. 8, 2016

(87) PCT Pub. No.: WO2015/170415
PCT Pub. Date: Nov. 12, 2015

(65) Prior Publication Data
US 2017/0146252 A1 May 25, 2017

(51) Int. Cl.
*F24F 6/04* (2006.01)
*F24F 13/22* (2006.01)

(52) U.S. Cl.
CPC ..... *F24F 6/04* (2013.01); *F24F 13/222* (2013.01); *F24F 2006/046* (2013.01)

(58) Field of Classification Search
CPC ..... F24F 6/04; F24F 2006/046; F24F 6/08; F24D 19/0082
See application file for complete search history.

(56) References Cited

FOREIGN PATENT DOCUMENTS

| | | | |
|---|---|---|---|
| JP | 4-143536 | A | 5/1992 |
| JP | 6-84230 | U | 12/1994 |
| JP | 2002-333174 | A | 11/2002 |
| JP | 2003-42488 | A | 2/2003 |
| JP | 2009-180434 | A | 8/2009 |
| JP | 2011-247496 | A | 12/2011 |
| JP | 2012-7842 | A | 1/2012 |
| WO | 2014/045609 | A1 | 3/2014 |

OTHER PUBLICATIONS

Office Action dated Dec. 13, 2016 in Japanese Patent Application No. 2016-517790 (with English translation).
International Search Report dated Jul. 29, 2014 in PCT/JP14/062526 Filed May 9, 2014.

*Primary Examiner* — Stephen Hobson
(74) *Attorney, Agent, or Firm* — Oblon, McClelland, Maier & Neustadt, L.L.P.

(57) ABSTRACT

A humidifier includes: a water supply portion (supply pipe, supply part, and nozzle) to supply water; a flat-shaped diffusing member that is provided below the water supply portion, and diffuses the water supplied from the water supply portion in a plane direction and in a thickness direction; a humidifying member that is fixed and has a top surface in contact with and the diffusing member, and evaporates the water supplied from the diffusing member via the top surface; and fixing parts that apply pressure to at least a part of a portion of contact between the diffusing member and the humidifying member.

19 Claims, 11 Drawing Sheets

HUMIDIFIER AND AIR-CONDITIONING APPARATUS INCLUDING HUMIDIFIER

TECHNICAL FIELD

The present invention relates to a humidifier and an air-conditioning apparatus including the humidifier.

BACKGROUND ART

With regard to specific buildings having a site area of 3000 $m^2$ or larger, such as commercial facilities and offices, the Act on Maintenance of Sanitation in Buildings, generally known as the Building Sanitation Law, stipulates an indoor temperature of 17 to 28 degrees C. and a relative humidity of 40 to 70% as control standard values for the air environment. With air conditioners becoming widespread, the indoor temperature is relatively easily controlled. However, the relative humidity is not sufficiently controlled, and especially insufficient humidification in winter needs to be addressed.

Conventional indoor humidification methods include a vaporizing method, a steaming method, and a water spraying method. In the vaporizing method, by passing air through a filter having a water absorbing property, heat is exchanged between the flowing air and water contained in the filter. Thus, the water is evaporated from the filter, and an indoor space is humidified. In the steaming method, in order to humidify an indoor space, water stored in a water tank is evaporated by energizing a heating unit for heating the water. In the water spraying method, in order to humidify an indoor space, water is micronized by applying pressure, and heat is exchanged between the micronized water and flowing air.

In a humidifier using the conventional vaporizing humidification method, a diffusing member for infiltrating water into a humidifying member, which retains the infiltrated water, is provided above the humidifying member, has a wave-shaped side, and is made of resin fibers (See Patent Literature 1, for example). In this humidifier, the wave-shaped side of the diffusing member makes it easy for water supplied from a water supply portion and diffused in the diffusing member to drop from each wave trough on the wave-shaped side, and for the water to evenly infiltrate into the humidifying member.

CITATION LIST

Patent Literature

Patent Literature 1: Japanese Unexamined Utility Model Registration Application Publication No. 6-84230 (pp. 1 to 7, FIG. 2)

SUMMARY OF INVENTION

Technical Problem

In the humidifier disclosed in Patent Literature 1, a diffusing member for infiltrating water into a humidifying member from above the humidifying member has a wave-shaped side and is made of resin fibers. However, if the diffusing member cannot keep a horizontal state and is inclined, water concentrates at some wave troughs on the wave-shaped side, and the water is not evenly supplied to the entire humidifying member. This decreases humidification performance.

In view of the problem, the objective of the present invention is to provide a humidifier or an air-conditioning apparatus including the humidifier in which even if a diffusing member cannot keep a horizontal state and is inclined, humidifying water is evenly supplied to an entire humidifying member and high humidification performance can be realized.

Solution to Problem

A humidifier according to an aspect of the present invention includes: a water supply portion configured to supply water; a diffusing member having a plate-shape, being provided below the water supply portion, and being configured to diffuse the water supplied from the water supply portion in a plane direction and in a thickness direction; a humidifying member fixed, with a top surface in contact with the diffusing member, the humidifying member being configured to evaporate the water supplied from the diffusing member via the top surface; and a presser member configured to apply pressure to at least a part of a portion in which the diffusing member and the humidifying member come in contact with each other.

An air-conditioning apparatus according to an aspect of the present invention includes the above humidifier.

Advantageous Effects of Invention

According to an aspect of the present invention, even if the diffusing member cannot keep a horizontal state and is inclined, humidifying water can be evenly supplied to the entire humidifying member. Accordingly, humidification performance can be improved.

DESCRIPTION OF EMBODIMENTS

Figure 1:
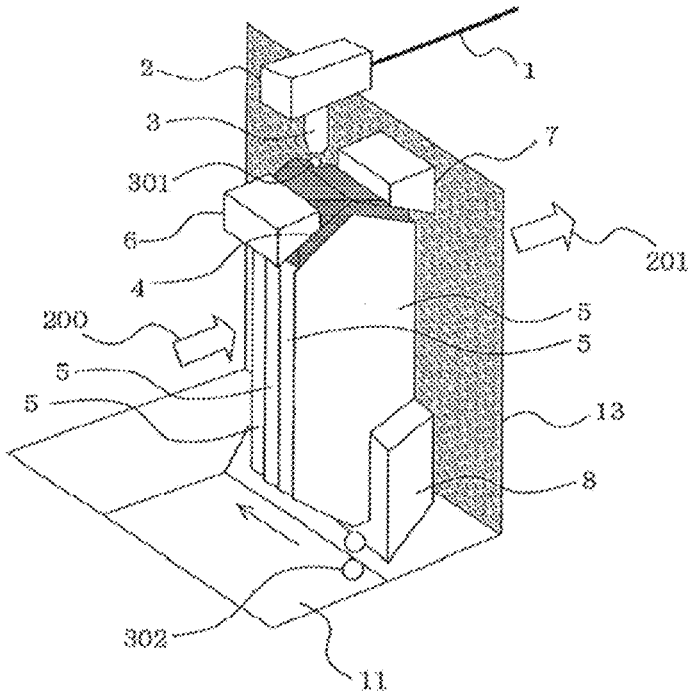
FIG. 1 is a perspective block diagram of a humidifier according to Embodiment 1 of the present invention.

The following describes embodiments of a humidifier according to the present invention with reference to the drawings. It should be noted that the present invention is not limited to examples illustrated in the drawings referred to below. It should be noted that identical reference signs are used to designate the same or corresponding components in the drawings.

Embodiment 1

(Whole Structure of Humidification Device)

Figure 2:
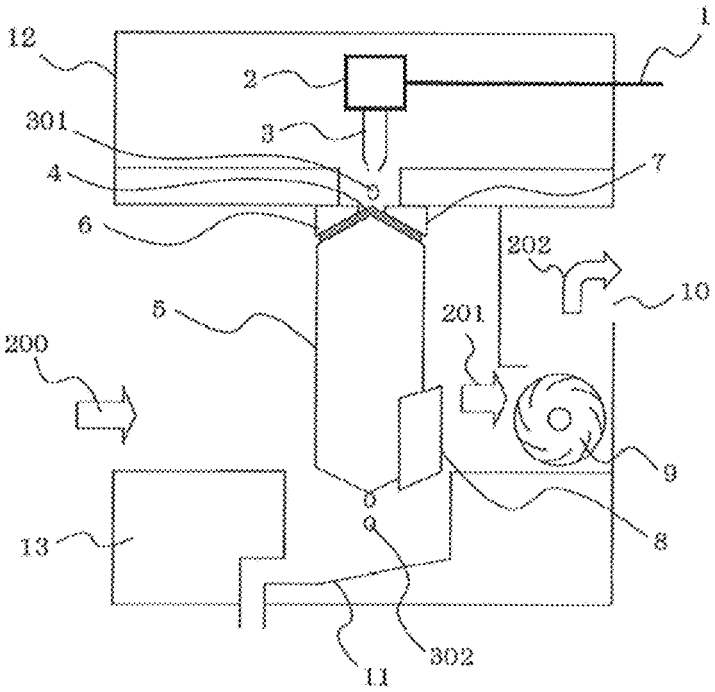
FIG. 2 is a cross-sectional block diagram of the humidifier according to Embodiment 1 of the present invention.

FIG. 1 is a perspective block diagram of a humidifier according to Embodiment 1 of the present invention. FIG. 2 is a cross-sectional block diagram of the humidifier according to Embodiment 1 of the present invention. The outline arrows in FIGS. 1 and 2 denote directions in which air flows.

As FIGS. 1 and 2 illustrate, the humidifier according to Embodiment 1 includes a supply pipe 1, a supply part 2, a nozzle 3, a diffusing member 4, and humidifying members 5. The supply pipe 1 supplies humidifying water to a space to be humidified. The supply part 2 stores the humidifying water supplied from the supply pipe 1. The nozzle 3 supplies the humidifying water stored in the supply part 2 downward as water droplets 301. It should be noted that the supply pipe 1, the supply part 2, and the nozzle 3 constitute a water supply portion according to the present invention.

The diffusing member 4 receives and temporarily retains the water droplets 301 and diffuses the water in a plane direction and in a thickness direction. The humidifying member 5 has cavities (pores) and retains the humidifying water supplied from the nozzle 3. It is preferable that the humidifying member 5 be a flat plate material having a certain thickness. The practical thickness of the humidifying member 5 is about 0.5 to 2 mm.

The humidifier further includes an upper portion upwind side fixing member 6 and an upper portion downwind side fixing member 7 that support an upper portion of the diffusing member 4, and a lower portion fixing member 8 that supports lower portions of the humidifying members 5. The humidifier further includes a fan 9 and a drain pan 11. The fan 9 is an air-sending unit for passing air through the humidifying members 5. The drain pan 11 receives water droplets 302 seeped from the humidifying members 5 and discharges the water droplets 302 to the outside of the humidifier.

The upper portion upwind side fixing member 6 and the upper portion downwind side fixing member 7 are attached to a casing 12 accommodating the supply part 2 and the nozzle 3. Although not illustrated in FIG. 2, the lower portion fixing member 8 is fixed or joined to a casing 13 accommodating the drain pan 11, on the front side of the humidifier (left side of FIG. 2) and on the rear side of the humidifier (right side of FIG. 2). In the casing 13, an air outlet 10 for sending out humidified air is provided on the downwind side of the fan 9.

It should be noted that hereinafter, the left side of FIG. 2 may be referred to as the upwind side of air flow or the front side of the humidifier, and the right side of FIG. 2 may be referred to as the downwind side of the air flow or the rear side of the humidifier.

The supply pipe 1, the supply part 2, and the nozzle 3 constitute a water supply portion for supplying humidifying water to the diffusing member 4. The supply of the humidifying water by the water supply portion is controlled by a not-illustrated control device.

The nozzle 3 is provided directly above the diffusing member 4 directly above the humidifying members 5. The nozzle 3 drops the humidifying water supplied from the supply pipe 1 and supplies the humidifying water to the top of the diffusing member 4. The humidifying water diffused in the plane direction inside the diffusing member 4 reaches the humidifying members 5.

The nozzle 3 is hollow, and the external shape and internal diameter of the nozzle 3 may be determined according to the size of the diffusing member 4. Moreover, the end of the nozzle 3 may have any of shapes such as a triangular pyramid shape, a circular pipe shape, and a quadrangular pipe shape. However, the end shape of the nozzle 3 here is preferably the triangular pyramid shape, and the diameter of an opening at the outlet of the nozzle 3 is set to 0.5 mm. Drainage is better when the end of the nozzle 3 has a smaller acute angle. Although a smaller acute angle is preferable, an excessively small acute angle increases difficulty of handling and weakens the strength of the nozzle 3. Thus, the acute angle is preferably 10 to 45 degrees.

If the diameter of the opening at the outlet of the nozzle 3 is too large, excessive water is supplied and some water is wasted. Meanwhile, if the diameter is too small, particles or scale mixed in the water easily clogs the nozzle 3. Thus, the diameter of the opening is preferably 0.3 to 0.7 mm. The nozzle 3 may be made of a metal such as stainless steel, tungsten, titanium, silver, or copper or a resin such as Teflon (registered trademark), polyethylene, or polypropylene. However, the material of the nozzle 3 is not limited to these examples.

The number of the nozzles 3 can be determined according to the length of the humidifying members 5 in a direction in which air flows (length of the humidifying members 5 from the upwind side to the downwind side). The humidifier is configured such that as the length of the humidifying members 5 in the direction in which air flows increases, the number of the nozzles 3 increases. For instance, if the length of the humidifying members 5 in the direction in which air flows is 60 mm or less, the number of the nozzles 3 may be one. However, if the length is more than 60 mm, it is preferable to provide two or more of the nozzles 3.

The amount of the humidifying water supplied from the nozzle 3 to the humidifying members 5 via the diffusing member 4 needs to be more than the amount of water used in actual humidification. However, excessive supply results in a waste of water. Thus, the amount of water should be controlled so that an appropriate amount is supplied. For instance, the following conditions are considered: the value of maximum humidification performance of the humidifying members 5 is 2000 mL/h/m$^2$, the size of the humidifying members 5 is 200 mm×50 mm, and both the front and back of the humidifying members 5 can be humidified, the following supply amount is set, for example. In this case, since a humidification amount per sheet of the humidifying member 5 is 40 mL/h, it is preferable that 1.5 to 5 times the humidification amount, that is, 60 to 200 mL/h humidifying water be supplied to each of the humidifying members 5.

As humidifying water for use in humidifying a space, any of pure water, tap water, soft water, and hard water may be used. However, to reduce clogging of the cavities of the humidifying members 5 due to scale (solid matter), water containing less mineral components including calcium ions or magnesium ions is preferable. This is because if humidifying water containing plenty of mineral components is used, solid matter is produced by reaction of ion components and carbon dioxide in the solution, and the solid matter may dog the cavities of the humidifying members 5. Humidifying water from which ion components are removed using, for example, an ion exchange membranes for positive ions and negative ions may be used. Moreover, preferably, the humidifying water does not contain as much organic matter as possible since soluble organic matter adheres to the humidifying members 5 and decreases the hydrophilic property of the surfaces of the humidifying members 5. As a guide, it is preferable that tap water or industrial water in which a total organic carbon (TOC) concentration is 3 mg/L or less be used as the humidifying water.

The humidifying members 5 may be made of any material as long as it has a three-dimensional meshwork structure with cavities. For instance, a woven fabric, a nonwoven fabric, a resin molded body with continuous pores, a porous ceramic body, or a porous metal body is preferable. The structure of the humidifying members 5 is similar to that of the diffusing member 4, which is described later. With any of the above materials used as the material of the humidifying members 5, water is more easily spread over the entirety of the humidifying members 5 by performing a hydrophilic treatment on the surfaces of the humidifying members 5. Thus, humidification performance improves. The type of hydrophilic treatment used is not particularly limited. For instance, a hydrophilic treatment in which the surfaces of the humidifying members 5 are coated with a hydrophilic resin may be performed, or a hydrophilic treatment with corona discharge or atmospheric pressure plasma may be performed.

Two or more humidifying members 5 are provided in the humidifier according to Embodiment 1. As FIG. 1 illustrates, the humidifying members 5 are spaced a predetermined distance apart in the solid-line arrow direction in FIG. 1 so that the planar surfaces of the humidifying members 5 are almost in parallel. That is, the humidifying members 5 are arranged substantially parallel to the direction in which air flows. It should be noted that in FIG. 1, the humidifying members 5 vertically extend. However, the humidifying members 5 need not vertically extend, but may be inclined, for example. Moreover, not all the planar surfaces of the humidifying members 5 need not be in parallel. For instance, only one planar surface may be inclined.

The material of the humidifying members 5 may be, for example, a metal such as titanium, copper, aluminum, or nickel, a noble metal such as gold, silver, or platinum, or an alloy such as stainless steel, nickel alloy, or cobalt alloy. Moreover, the humidifying members 5 may be obtained by plating the surface of a base metal such as titanium, copper, or nickel with, for example, platinum, chromium, or tin. Furthermore, a non-woven fabric, a sponge-like resin foam, or a porous ceramic may be used. In Embodiment 1, the humidifying members 5 are made of a nickel-based porous metal body.

The top of the humidifying member 5 is triangular roof shaped and is inclined from the center of the top surface toward the upwind side and toward the downwind side along the shape of the diffusing member 4, which is described later. The tip of the top of the humidifying member 5 is directly below the nozzle 3.

(Structure of Diffusing Member)

Figure 3:
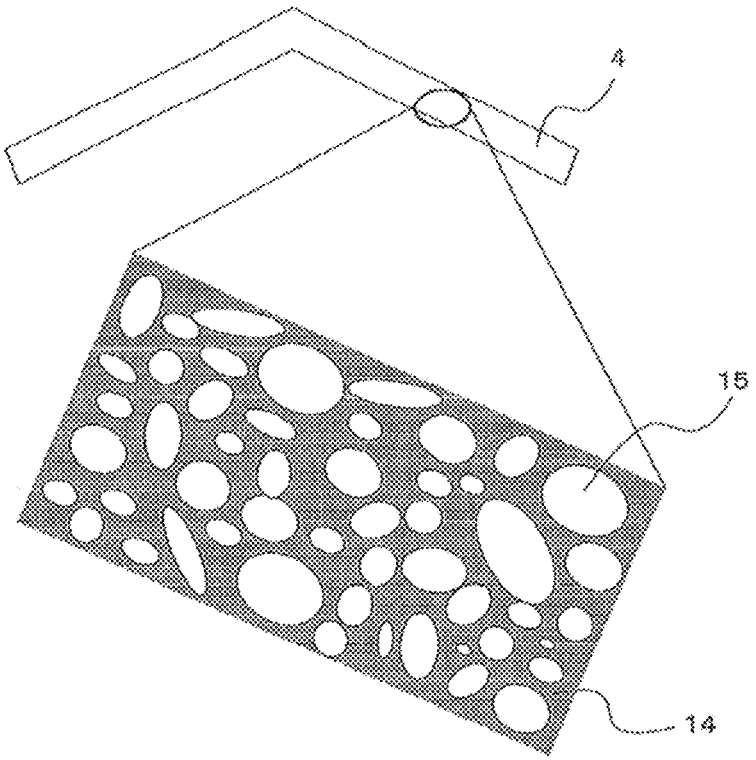
FIG. 3 is a partially enlarged cross-sectional view of a diffusing member 4 of the humidifier according to Embodiment 1 of the present invention.

FIG. 3 is a partially enlarged cross-sectional view of the diffusing member 4 of the humidifier according to Embodiment 1 of the present invention. As FIG. 3 illustrates, the diffusing member 4 has a three-dimensional meshwork structure, and this structure is similar to that of a resin foam such as a sponge. The diffusing member 4 is made of a metal portion 14 having cavities (pores) 15.

Thus, the diffusing member 4 is made of a porous metal that is a porous material having a three-dimensional meshwork structure with the cavities 15. The diffusing member 4 according to Embodiment 1 is shaped by bending a substantially flat plate material. Specifically, the diffusing member 4 is bent to have a triangular roof shape and is inclined downward from a portion directly below the nozzle 3 toward the upwind side and toward the downwind side. In Embodiment 1, the shape of the diffusing member 4 is referred to as "triangular roof".

Moreover, the diffusing member 4 is supported by the humidifying members 5, the upper portion upwind side fixing member 6 and the upper portion downwind side fixing member 7 provided above the diffusing member 4 and the humidifying members 5, and the lower portion fixing member 8 provided at the lower portions of the humidifying members 5. That is, the diffusing member 4 is fixed to the casing 12 and the casing 13. In the fixed state, portions of the top surface of the diffusing member 4, more specifically, portions of the top surface of the diffusing member 4 except for the portion directly below the nozzle 3 are pressed by the upper portion upwind side fixing member 6 and the upper portion downwind side fixing member 7.

Thus, the humidifying members 5 are fixed to the casing 12 and the casing 13 in a state in which the humidifying members 5 are pressed from above in the same way as the diffusing member 4. The upper portion upwind side fixing member 6 and the upper portion downwind side fixing member 7 constitute a presser member of the present invention. This is the same in Embodiments 2 to 14 described below. It should be noted that in Embodiment 1, a fixing part for fixing the diffusing member 4 and the humidifying members 5 to the casing 12 and the casing 13 also functions as the presser member. However, instead of such a dual-purpose component, a component dedicated for applying pressure may be used as the presser member.

The diffusing member 4 diffuses humidifying water in the plane direction and in the thickness direction, and evenly supplies the humidifying water to the entirety of the humidifying members 5. However, the diffusing member 4 except for the bottom surface of the diffusing member 4 in contact with the humidifying members 5 does not contribute to humidification. Thus, it is preferable that the diffusing member 4 be designed to be suitable for diffusing water in the plane direction. The material and shape of the diffusing member 4 need not be the same as those of the humidifying members 5. It is preferable to choose a material and a shape suitable for diffusing water in the plane direction.

Figure 4:
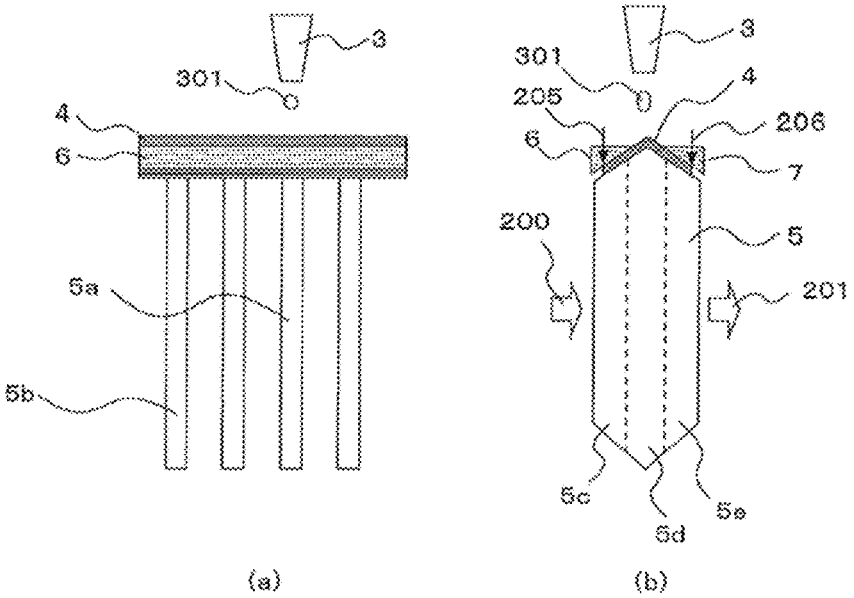
FIG. 4 illustrates a detailed positional relation of a nozzle 3, the diffusing member 4, a humidifying member 5, an upper portion upwind side fixing member 6, and an upper portion downwind side fixing member 7 of the humidifier according to Embodiment 1 of the present invention.

FIG. 4 illustrates a detailed positional relation of the nozzle 3, the diffusing member 4, the humidifying member 5, the upper portion upwind side fixing member 6, and the upper portion downwind side fixing member 7 of the humidifier according to Embodiment 1 of the present invention. FIG. 4 (*a*) illustrates the nozzle 3, the diffusing member 4, the humidifying member 5, the upper portion upwind side fixing member 6, and the upper portion downwind side fixing member 7 when viewed from the upwind side. FIG. 4 (*b*) is a cross-sectional view of FIG. 4 (*a*).

As an arrow 205 and an arrow 206 denote, the upper portion upwind side fixing member 6 and the upper portion downwind side fixing member 7 apply pressure downward and press some portions of the diffusing member 4 as described above. Not the entire surface of the diffusing member 4, but a portion on the upwind side and a portion on the downwind side are pressed. The portion directly below the nozzle 3 is not pressed. Although pressure to be applied needs to be determined in consideration of the mechanical strength of the humidifying members 5, the appropriate pressure is about 100 to 1000 Pa.

In a state in which the diffusing member 4 is not provided in the structure illustrated in FIG. 4, if water is directly supplied from the nozzle 3 to the humidifying members 5, the water concentrates at the portion directly below the nozzle 3, that is, at a humidifying member 5*a* and at a humidifying member center portion 5*d*. In this case, the water is difficult to diffuse in a humidifying member 5*b*, a humidifying member upstream portion 5*c*, and a humidifying member downwind portion 5*e* that are not directly below the nozzle 3. Thus, humidification performance decreases. However, in Embodiment 1, the provision of the diffusing member 4 improves the humidification performance, and the application of pressure to the diffusing member 4 further improves the humidification performance. Details are described below.

To improve the humidification performance, it is basically preferable that the diffusing member 4 and the humidifying members 5 be joined together without a gap or be integrally formed without a gap. If there is any gap, even if partially, water concentrates at a portion where there is no gap, and the water cannot be evenly supplied to the entirety of the humidifying members 5, thereby decreasing the humidification performance. As FIG. 4 illustrates, the application of pressure to the diffusing member 4 reduces gaps between the diffusing member 4 and the humidifying members 5 and increases an effective portion of contact. The increase of the contact portion enables smooth supply of water. Water can be efficiently diffused in the humidifying member upstream portion 5*c* and the humidifying member downwind portion 5*e*, which are not directly below the nozzle 3, by intensively applying pressure to some portions of the diffusing member 4, that is, upper portions of the humidifying member upstream portion 5*c* and the humidifying member downwind portion 5*e*.

The porous material forming the diffusing member 4 is generally used in, for example, a filter, a catalyst support, and a gas diffusion layer for a fuel cell, and can be manufactured by a publicly known technique. For instance, a porous metal can be manufactured by injecting bubbles into a slurry containing a solvent and metal powders serving as a raw material of the porous metal, forming the slurry into a desired shape, and then sintering the slurry. Alternatively, a porous metal can be also manufactured by making metal powders serving as a raw material of the porous metal adhere to a commercial sponge porous resin serving as a base material, and then decomposing and eliminating the resin material by high-temperature calcination.

A metal capable of forming the diffusing member 4 may be, for example, a metal such as titanium, copper, aluminum, or nickel, a noble metal such as gold, silver, or platinum, or an alloy such as stainless steel, nickel alloy, or cobalt alloy. Moreover, the diffusing member 4 may be obtained by plating the surface of a base metal such as titanium, copper, or nickel with, for example, platinum, chromium, or tin.

A single metal may be used, or two or more metals may be combined. Moreover, the solvent for use in the manufacturing of a porous metal is not particularly limited. For instance, water may be used as the solvent. The resin material serving as a base material for use in the manufacturing of a porous metal is not particularly limited. For instance, an acrylate resin, an epoxy resin, or a polyester resin may be used. The sintering temperature is not particularly limited. The temperature may be appropriately adjusted in accordance with a material used.

It should be noted that, in general, when a metal is soaked in water, metal ions having antimicrobial and antifungal activities are eluted. Thus, it is preferable to choose a metal having high antimicrobial and antifungal performance. Specifically, if silver, copper, chromium, nickel, zinc, tin, titanium, or aluminum is used, bacteria or fungi are less likely to multiply on the surface of or inside the diffusing member 4. Thus, these metals are preferable. In Embodiment 1, a material made of 100% nickel is used since nickel is resistant to corrosion and has a strong bactericidal activity.

Moreover, a porous resin material coated with metal powders may be used as the diffusing member 4.

Moreover, a ceramic may be used instead of a metal. In the same way as the metal is used, the following manufacturing process is applied: for instance, bubbles are injected into a slurry containing ceramic powders and a solvent, the slurry is formed into a desired shape, and then the slurry is sintered.

Moreover, it is preferable to perform a hydrophilic treatment on the surface layer of the diffusing member 4 from the perspective of an increase in the amount of humidifying water retained, diffusion of the water in the diffusing member 4, and prevention of degradation of a water absorbing property. The type of hydrophilic treatment used is not particularly limited. For instance, a hydrophilic treatment in which the surface of the diffusing member 4 is coated with a hydrophilic resin may be performed, or a hydrophilic treatment with corona discharge or atmospheric pressure plasma may be performed. The following describes an example of a hydrophilic treatment for the diffusing member 4.

(Hydrophilic Treatment)

The following describes an example of a specific method of coating the diffusing member 4 with a hydrophilic material. The diffusing member 4 in which nickel is used is soaked in 5% sulfuric acid for three minutes, and an oxide on the surface of the diffusing member 4 is removed. Then, the diffusing member 4 is soaked in a 100 mg/L sodium silicate aqueous solution for 10 minutes and is dried at 80 degrees C. for five hours. In this manner, a silica coating film is formed on the surface of the diffusing member 4.

Preferably, the thickness of the coating film is about 0.01 to 10 μm. An excessively thick film is not preferable because it blocks pores of bubble portions. However, an excessively thin film is not preferable either because the film peels off as time elapses, the hydrophilic property of the surface decreases, and a water holding capacity decreases.

As a hydrophilic material, a silane coupling agent or a titanium oxide dimethylformamide solution may be used instead of silica. In addition, an organic polymeric resin may be used. For instance, a polyvinyl alcohol, polyethylene glycol, cellulose, or epoxy dimethylformamide solution may be used.

It should be noted that an atmospheric pressure plasma treatment may be performed as a preliminary treatment of the coating treatment. This can increase adhesive strength of the coating film and a metal foam and improve durability.

The diffusing member 4 having a desired shape may be obtained by preparing a porous metal sheet with a thickness of 0.5 mm or more, and then cutting the sheet so as to be the desired shape. At a sheet thickness of less than 0.5 mm, the volume of water to be diffused in the plane direction is small. Thus, diffusing capacity significantly decreases (that is, a buffer decreases). Mechanical strength also decreases. Thus, a thickness of less than 0.5 mm is not appropriate. There is no particular upper limit to the thickness. However, for a foamed metal with a thickness of 5 mm or more, there is hardly any difference in humidification performance. The method of processing the diffusing member 4 into a desired shape is not particularly limited. For instance, wire cutting, laser cutting, press punching, shaving, hand cutting, bending, or various other methods may be used.

The porosity of the diffusing member 4 is preferably 60 to 90%. At this porosity, water absorption by the diffusing member 4 can be sufficiently ensured while the strength of the diffusing member 4 can be appropriately maintained.

Since the diffusing member 4 has capillarity, the water droplets 301 from the supply part 2 can be efficiently supplied to and diffused in the diffusing member 4 without providing a driving unit such as a pump.

The porosity and pore size distribution of the diffusing member 4 can be changed by changing, for example, the particle diameter of a metal powder, a sintering temperature, and the specifications of a porous resin serving as the base material. The pore sizes of pores are generally not uniform, but vary. The size of pores judged to be dominant from appearance by, for example, observing with a microscope is generally referred to as a nominal pore size. If the pore size distribution needs to be accurately examined, it is analyzed by a publicly known method referred to as a mercury press-in method. A pore size obtained as a peak in the pore size distribution measured by the mercury press-in method is not necessarily identical to the nominal pore size. The pore size distribution obtained by the mercury press-in method assumes a cylindrical model in which the diameter of a pore is a pore size. The following describes the principle of the mercury press-in method. The relation shown by the expression (1) is established between pressure and pore size.

$$D=-4\sigma(\cos\theta)/P \quad (1)$$

Here, D (m) is the pore size, θ (degree) is the contact angle of mercury, σ (N/m) is the surface tension of the mercury, and P (Pa) is pressure.

In the measurement of the pore size distribution by the mercury press-in method, the porous material forming the diffusing member 4 is placed in a tank filled with mercury, and the pressure applied to the mercury is changed. The pressure and volume change in mercury content are measured, and the features of the pore size distribution can be obtained using a volume derived from each pore size and the expression (1).

It should be noted that preferably, the diffusing member 4 and the humidifying members 5 are joined together without a gap or are integrally formed without a gap. If there is any gap, even if partially, water concentrates at a portion where there is no gap. Thus, water cannot be evenly supplied to the entirety of the humidifying members 5, thereby decreasing the humidification performance.

It should be noted that in Embodiment 1, the diffusing member 4 is made of a porous metal. However, instead of the porous metal, a porous material obtained by solidifying metal fibers into porous metal fibers may be used. Such a porous material has a structure in which, for example, many metal fibers of about φ0.1 mm are intricately entangled. There are spaces between the entangled metal fibers, and water is retained in these spaces. The material of the metal fibers is similar to the above metals capable of forming the diffusing member 4. For instance, a metal such as titanium, copper, aluminum, tin, or nickel, a noble metal such as gold, silver, or platinum, or an alloy such as stainless steel, nickel alloy, or cobalt alloy can be used. Such metal fibers may be processed into a shape similar to that of the diffusing member 4 illustrated in FIG. 1.

(Operation of Humidification Device)

The following describes operations of the humidifier according to Embodiment 1 with reference to FIG. 1 or 2. The humidifier according to Embodiment 1 selectively performs a humidifying operation and a drying operation.

(Humidifying Operation)

The following describes the humidifying operation of the humidifier according to Embodiment 1.

Water supplied from the supply pipe 1 is stored in the supply part 2, and the water stored in the supply part 2 is supplied to the nozzle 3 as humidifying water. The humidifying water supplied to the nozzle 3 drops on the top of the diffusing member 4, and the humidifying water is diffused in the plane direction and in the vertical direction inside the diffusing member 4, using the inclinations and capillarity of the diffusing member 4 and the gravity of the humidifying water. The diffused humidifying water is supplied from the bottom surface of the diffusing member 4 to the top surfaces of the humidifying members 5 by gravitation, and is then supplied to the inside of the humidifying members 5. Here, as FIG. 4 illustrates, pressure is applied downward (arrow 205) from the upper portion upwind side fixing member 6, and pressure is applied downward (arrow 206) from the upper portion downwind side fixing member 7. Thus, there is no gap at the contact portion of the diffusing member 4 and the humidifying members 5, enabling speedy water supply. Accordingly, the water is evenly infiltrated not only into the humidifying member center portion 5*d* but also into the humidifying member upstream portion 5*c* and the humidifying member downwind portion 5*e*.

Moreover, since the humidifying members 5 have a three-dimensional meshwork structure as with the diffusing member 4, a certain amount of water can be retained.

When the fan 9 operates, air flows from the upper stream side of the humidifying members 5 (left side of FIG. 2) toward the downwind side of the humidifying members 5 (right side of FIG. 2) (arrow 200 in FIG. 2), then passes through the humidifying members 5, is sucked by the fan 9 (arrow 201 in FIG. 2), and is conveyed to the outside of the humidifier (arrow 202 in FIG. 2). The water retained in the humidifying members 5 is evaporated by vapor-liquid contact, that is, by contact with the air caused to flow by the operation of the fan 9, thereby humidifying the air.

Surplus water in the humidifying members 5 that has not been used for humidification concentrates at the lower portions of the humidifying members 5 by gravity, and seeps and drops downward. The water seeped from the humidifying members 5 is received by the drain pan 11 and is discharged to the outside of the humidifier.

Through such a humidifying operation by the humidifier, the humidified air can be supplied to a space to be humidified.

(Drying Operation)

The following describes the drying operation of the humidifier according to Embodiment 1.

After performing the humidifying operation for a predetermined period, the humidifier performs a drying operation in which the humidifying members 5 are dried by stopping the nozzle 3 from dropping water, and making the fan 9 continue to operate for a certain time and send wind to the humidifying members 5. By drying the humidifying members 5 through the drying operation, the growth of microorganisms such as bacteria or fungi is suppressed in the humidifying members 5. The growth of microorganisms such as bacteria or fungi renders the humidifying members 5 unhygienic, and when the humidifying operation is restarted, the microorganisms or fungal spores may be mixed into the air. Thus, the growth of microorganisms should be avoided. It should be noted that in the drying operation, the air from the fan 9 may be directly sent, or the air from the fan 9 may be heated by a heating unit such as a not-illustrated heater and warm air may be sent. If the warm air is sent, the drying time is saved. However, heating requires energy. Thus, whether air is directly sent or warm air is sent is determined according to an objective specification.

It is preferable to determine the frequency of the drying operation according to the multiplication rate of microorganisms. For instance, *Escherichia coli* (*E. coli*) multiplies in large quantities for one day under suitable conditions for the growth of *Escherichia coli*. In view of this, it is preferable to perform the drying operation after the end of the humidifying operation of the day. However, when the drying operation is frequently performed for the humidifying members 5, scale in the water is deposited and humidification performance decreases. Thus, it is preferable to determine the frequency of the drying operation in consideration of the growth rate of bacteria or fungi and the hardness of tap water.

Effects of Embodiment 1

In the humidifier according to Embodiment 1, pressure is applied from the upper portion upwind side fixing member 6 and the upper portion downwind side fixing member 7 to some portions of the contact portion of the diffusing member 4 and the humidifying members 5. This increases the adhesion of the diffusing member 4 and the humidifying members 5, allowing water to be diffused in the plane direction of the diffusing member 4 at a high speed. Thus, even if the humidifier cannot keep a horizontal state and is inclined, the water can be evenly supplied to the humidifying members 5. Accordingly, high humidification performance can be obtained.

It should be noted that in Embodiment 1, the diffusing member 4 is "triangular roof" shaped. However, the shape of the diffusing member 4 is not limited to this shape. For instance, the diffusing member 4 may have a simple rectangular shape. In this case, the top surface of the humidifying members 5 may be a flat surface following the shape of the diffusing member 4.

Embodiment 2

Embodiment 2 is different from Embodiment 1 in the shape of a diffusing member 4. The following mainly describes differences between a humidifier according to Embodiment 2 and the humidifier according to Embodiment 1. Matters that are not particularly stated below have no differences from the same matters in Embodiment 1. This is the same also in the subsequent embodiments.

Figure 5:
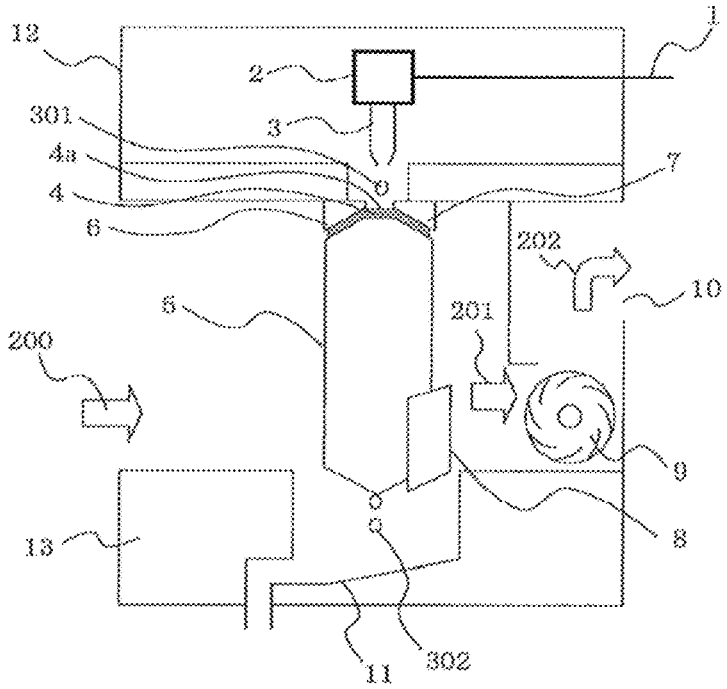
FIG. 5 is a cross-sectional block diagram of a humidifier according to Embodiment 2 of the present invention.

FIG. 5 is a cross-sectional block diagram of the humidifier according to Embodiment 2 of the present invention.

The shape of the diffusing member 4 in Embodiment 2 is different from that in Embodiment 1. In Embodiment 2, the top of the diffusing member 4 directly below a nozzle 3 is not a corner but a horizontal flat plate 4*a*. In Embodiment 2, this shape is referred to as a "trapezoid roof". The upwind side and the downwind side of the diffusing member 4 are inclined. An upper portion upwind side fixing member 6 and an upper portion downwind side fixing member 7 are in contact with and follow the inclined portions of the diffusing member 4 and apply pressure. This structure is the same as described in Embodiment 1. Other structure is also the same as described in Embodiment 1.

The procedure of a humidifying operation of the humidifier is the same as described in Embodiment 1. However, since the top of the diffusing member 4 is the flat plate 4*a*, water droplets 301 from the nozzle 3 can be more evenly diffused. In Embodiment 1, the top of the diffusing member 4 is directly below the nozzle 3. That is, the top of the diffusing member 4 and the nozzle 3 are positioned on the same vertical plane, and if the top of the diffusing member 4 and the nozzle 3 are moved due to, for example, vibration, water is not evenly diffused. Thus, in Embodiment 2, water can be more stably diffused, and higher humidification performance can be obtained.

The procedure of a drying operation is the same as described in Embodiment 1.

Effects of Embodiment 2

In the humidifier according to Embodiment 2, the top of the diffusing member 4 directly below the nozzle 3 is not a corner but the horizontal flat plate 4*a*, and the upwind side and the downwind side of the diffusing member 4 are inclined. Thus, as with Embodiment 1, even if the whole humidifier cannot keep a horizontal state and is inclined, water can be evenly supplied to the entire humidifying member. Accordingly, high humidification performance can be obtained.

Embodiment 3

Embodiment 3 is different from Embodiment 1 in the shape of a diffusing member 4. The following mainly describes differences between a humidifier according to Embodiment 3 and the humidifier according to Embodiment 1.

Figure 6:
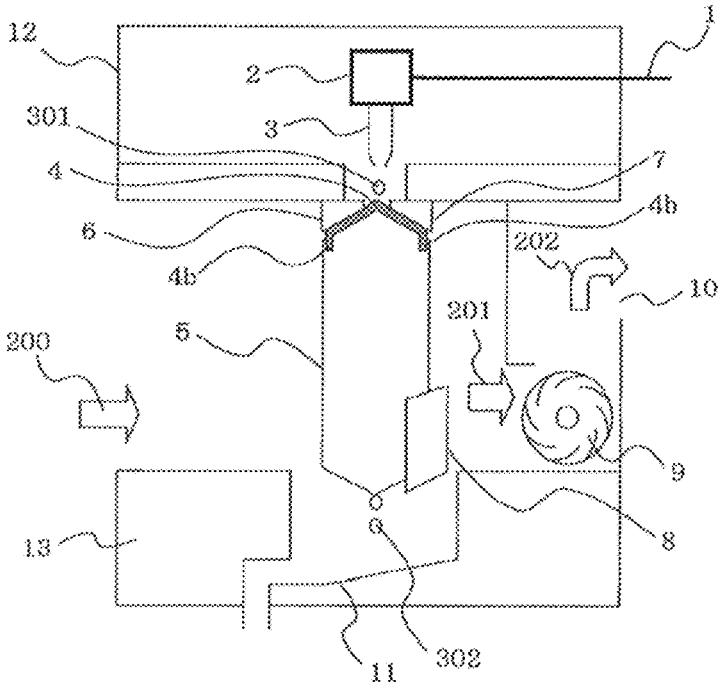
FIG. 6 is a cross-sectional block diagram of a humidifier according to Embodiment 3 of the present invention.
Figure 7:
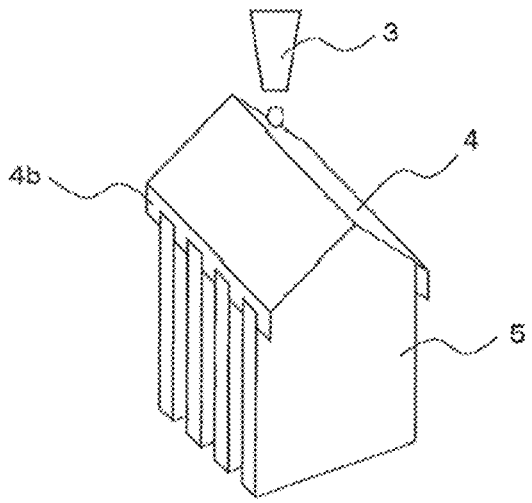
FIG. 7 is a perspective block diagram illustrating a positional relation of a nozzle 3, a diffusing member 4, diffusing member comb teeth 4*b*, and a humidifying member 5 of the humidifier according to Embodiment 3 of the present invention.

FIG. 6 is a cross-sectional block diagram of the humidifier according to Embodiment 3 of the present invention. FIG. 7 is a perspective block diagram illustrating a positional relation of a nozzle 3, the diffusing member 4, diffusing member comb teeth 4*b*, and humidifying members 5 of the humidifier according to Embodiment 3 of the present invention.

The shape of the diffusing member 4 in Embodiment 3 is different from that in Embodiment 1 in that end portions of the diffusing member 4 extend in a direction perpendicular to the direction in which the humidifying members 5 are arranged, and are toothed so as to engage with the humidifying members 5. Specifically, the diffusing member comb teeth 4*b*, which are part of the toothed diffusing member 4, are provided at bent end portions of the upstream-side inclination and the downwind-side inclination of the diffusing member 4. The diffusing member comb teeth 4*b* engage with upper end portions of the humidifying members 5.

An upper portion upwind side fixing member 6 and an upper portion downwind side fixing member 7 are in contact with and follow the inclined portions of the diffusing member 4 and apply pressure to the diffusing member 4 and the humidifying members 5. This structure is the same as described in Embodiment 1. Other structure is also the same as described in Embodiment 1. Moreover, the diffusing member comb teeth 4*b* can be used irrespective of the shape of the diffusing member 4. For instance, the diffusing member comb teeth 4*b* can be used not only in the case in which the diffusing member 4 is triangular roof shaped as described in Embodiment 3, but also, for example, in the case in which the diffusing member 4 is trapezoid roof shaped as described in Embodiment 2 or in a case in which the humidifying members 5 are simple rectangular shaped.

The procedure of a humidifying operation of the humidifier is the same as described in Embodiment 1. However, the provision of the diffusing member comb teeth 4*b* increases the contact area of the diffusing member 4 and the humidifying members 5. Thus, water droplets 301 from the nozzle 3 can be more evenly diffused.

The following describes test results showing effects of the humidifying operations of the humidifiers according to Embodiments 1 to 3 of the present invention.

In tests, the structures illustrated in FIGS. 1, 2, 5, 6, and 7 were applied to the humidifiers, and the shape of the diffusing member 4 and the shapes of the top surfaces of the humidifying members 5 were changed. Table 1 shows conditions of each test. For instance, for A-1, the diffusing member 4 is simple rectangular shaped. A pressing force (pressure) is not applied from the upper portion upwind side fixing member 6 and the upper portion downwind side fixing member 7 to the end portions of the diffusing member 4. The comb teeth of the diffusing member 4, that is, the diffusing member comb teeth 4*b* are not provided. Likewise, for A-2 to A-4, the diffusing members 4 are simple rectangular shaped. For B-1 to B-4, the diffusing members 4 are triangular roof shaped as illustrated in FIGS. 1, 2, 6, and 7. For C-1 to C-4, the diffusing members 4 are trapezoid roof shaped as illustrated in FIG. 5. Humidifying operations were performed under all the above test conditions.

TABLE 1

| Number | Shape of Diffusing Material | Existence of Pressing Force (Pressure) to End Portions | Existence of Diffusing Material Comb Teeth 4b |
|---|---|---|---|
| A-1 | Simple Rectangular | No | No |
| A-2 | ↑ | Yes | No |
| A-3 | ↑ | No | Yes |
| A-4 | ↑ | Yes | Yes |
| B-1 | Triangular Roof | No | No |
| B-2 | ↑ | Yes | No |
| B-3 | ↑ | No | Yes |
| B-4 | ↑ | Yes | Yes |
| C-1 | Trapezoid Roof | No | No |
| C-2 | ↑ | Yes | No |
| C-3 | ↑ | No | Yes |
| C-4 | ↑ | Yes | Yes |

It should be noted that the temperature and relative humidity of air on the upwind side of the humidifying members 5 were set to 20 degrees C. and 50%, respectively. The temperature and relative humidity of the air on the downwind side of the humidifying members 5 were measured with a hygrothermograph (HC2-S of ROTRONIC), and a change in absolute humidity was obtained. Then, humidification performance (unit of the value is $mL/h/m^2$) per unit surface area of the porous metal body was calculated. The numerical value of humidification performance for A-1 in Table 1 was set to 1.0, and relative values of humidification performance obtained in the tests were obtained. In this manner, results shown in FIG. 8 were obtained.

Figure 8:
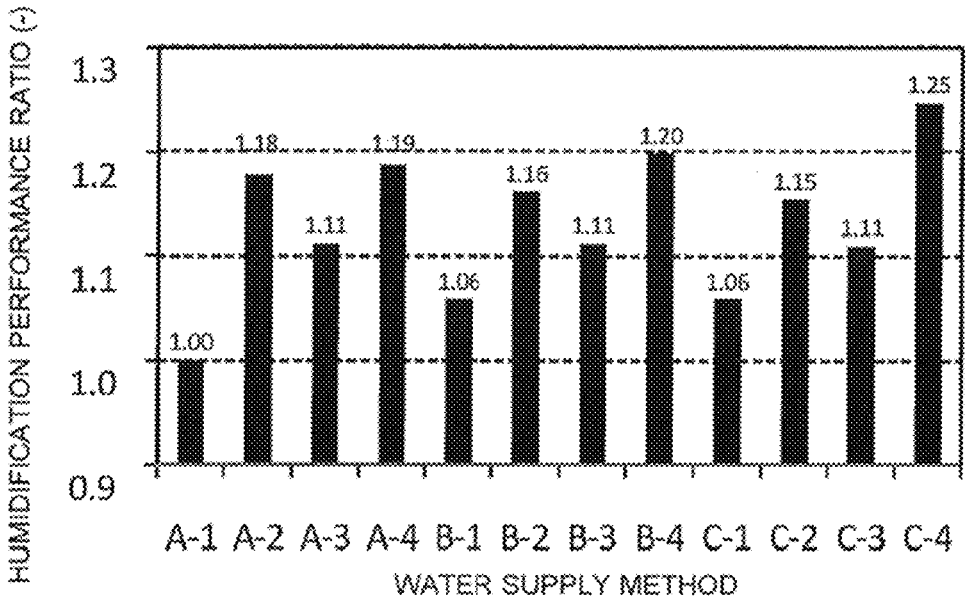
FIG. 8 shows results of testing humidification performance of the humidifier according to Embodiment 3 of the present invention.

FIG. 8 shows the results of testing humidification performance of the humidifier according to Embodiment 3 of the present invention.

FIG. 8 shows that the humidification performance is highest at C-4 having conditions: the diffusing member 4 is trapezoid roof shaped, a pressing force is applied to the end portions of the diffusing member 4, and the diffusing member comb teeth 4*b* are provided. However, the humidification performance was improved even by changing one of the conditions: (i) the shape of the diffusing member 4, (ii) existence of a pressing force to the end portions of the diffusing member 4, and (iii) the provision of the diffusing member comb teeth 4*b*. Thus, if there is a physical space limitation, a cost limitation, or other limitation, the above conditions may be appropriately determined according to the situation.

The procedure of a drying operation is the same as described in Embodiment 1.

Effects of Embodiment 3

In the humidifier according to Embodiment 3, the diffusing member comb teeth 4*b* of the diffusing member 4 are provided so as to engage with the humidifying members 5. Thus, as with Embodiment 1, even if the whole humidifier cannot keep a horizontal state and is inclined, water can be evenly supplied to the entire humidifying member. Accordingly, high humidification performance can be obtained.

Embodiment 4

Embodiment 4 is different from Embodiment 1 in the shape of a diffusing member 4 and the shapes of the top surfaces of humidifying members 5. The following mainly describes differences between a humidifier according to Embodiment 4 and the humidifier according to Embodiment 1.

Figure 9:
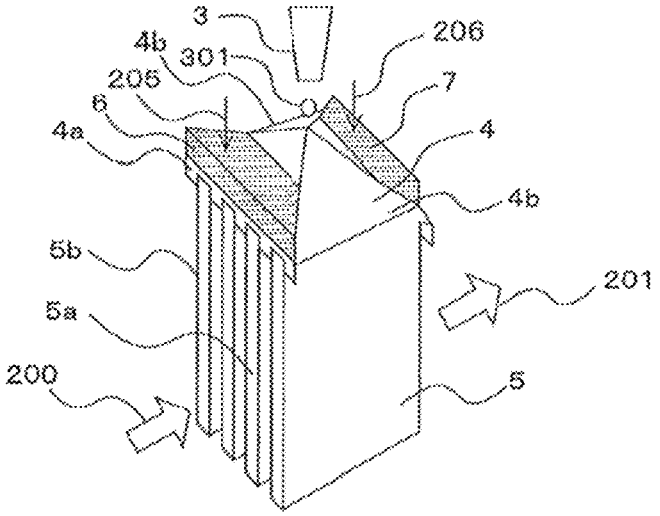
FIG. 9 is a perspective block diagram of a humidifier according to Embodiment 4 of the present invention.

FIG. 9 is a perspective block diagram of the humidifier according to Embodiment 4 of the present invention.

In Embodiment 1, the upwind side and the downwind side of the diffusing member 4 are inclined. In Embodiment 4, the right side and the left side of the diffusing member 4 are also inclined, and the diffusing member 4 has a quadrangular pyramid-like roof shape. The shapes of the top surfaces of the humidifying members 5 are determined so that the shape of the top surface of the entirety of the humidifying members 5 follows the shape of the diffusing member 4. The diffusing member 4 may be made of four triangular-shaped sheets in which the end faces of the sheets are bonded together, or the diffusing member 4 may be shaped by bending a flat plate material. It should be noted that as with FIG. 4, a humidifying member 5*a* is directly below a nozzle 3, and a humidifying member 5*b* is far from a portion directly below the nozzle 3.

The procedures of a humidifying operation and a drying operation are the same as described in Embodiment 1.

Effects of Embodiment 4

In the humidifier according to Embodiment 4, not only the upwind side and the downwind side of the diffusing member 4 are inclined, but also the right side and the left side when viewed from the upwind side of the humidifying members 4 are inclined. Accordingly, water can be effectively diffused on the right side and on left side, that is, in the humidifying member 5*a* and in the humidifying member 5*b*, as well as on the upwind side and on the downwind side. This can suppress unbalanced diffusion of water. Thus, as with Embodiment 1, even if the whole humidifier cannot keep a horizontal state and is inclined, water can be evenly supplied to the entire humidifying member. Accordingly, high humidification performance can be obtained.

Embodiment 5

Embodiment 5 is different from Embodiment 1 in the shape of a diffusing member 4 and the shape of the top surface of a humidifying member 5. The following mainly describes differences between a humidifier according to Embodiment 5 and the humidifier according to Embodiment 1.

Figure 10:
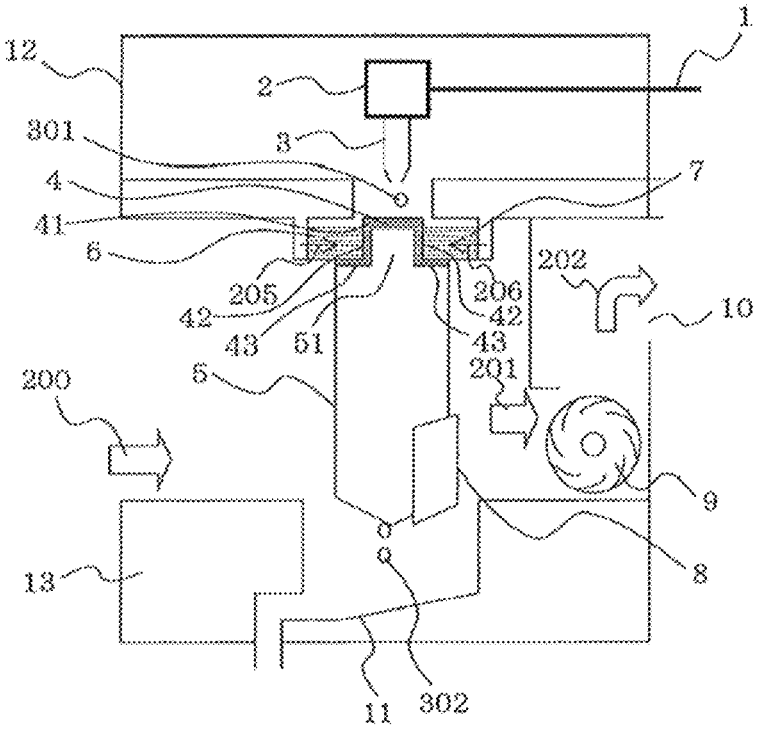
FIG. 10 is a cross-sectional view of the side of a humidifier according to Embodiment 5 of the present invention.

FIG. 10 is a cross-sectional view of the side of the humidifier according to Embodiment 5 of the present invention.

In Embodiment 5, the top surface of the humidifying member 5 has a projection 51 at a portion including a portion directly below a nozzle 3. The diffusing member 4 follows the shape of the top surface of the humidifying member 5. To obtain the diffusing member 4 following the shape of the top surface of the humidifying member 5, the diffusing member 4 having a rectangular shape may be bent.

Specifically, the diffusing member 4 includes a top portion 41, side portions 42, and bottom portions 43. The top portion 41 covers the top surface of the projection 51 of the humidifying member 5. The side portions 42 cover the side surfaces of the projection 51. The bottom portions 43 cover the top surface of the humidifying member 5 except for the projection 51. The diffusing member 4 is pressed and bonded to the humidifying member 5 by an upper portion upwind side fixing member 6 and an upper portion downwind side fixing member 7 applying pressure to the side surfaces of the projection 51 of the humidifying member 5 via the side portions 42 of the diffusing member 4 in directions horizontal to a casing 12, that is, in an arrow 205 direction and in an arrow 206 direction.

The procedures of a humidifying operation and a drying operation are the same as described in Embodiment 1.

Effects of Embodiment 5

In the humidifier according to Embodiment 5, the top surface of the humidifying member 5 has the projection 51, and the diffusing member 4 follows the shape of the top surface of the humidifying member 5. Pressure is applied to the side surfaces of the projection 51 of the humidifying member 5 and to the side portions 42 of the diffusing member 4, which cover the side surfaces of the projection 51, in the horizontal directions. Thus, as with Embodiment 1, even if the whole humidifier cannot keep a horizontal state and is inclined, water can be evenly supplied to the entire humidifying member. Accordingly, high humidification performance can be obtained.

Embodiment 6

Embodiment 6 is different from Embodiment 1 in the shape of a diffusing member 4 and the shape of the top surface of a humidifying member 5. The following mainly describes differences between a humidifier according to Embodiment 6 and the humidifier according to Embodiment 1.

Figure 11:
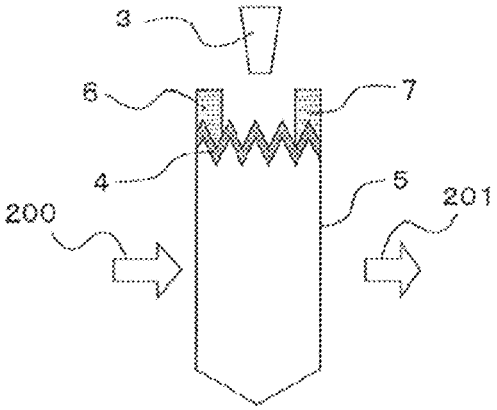
FIG. 11 is a cross-sectional view of the side of a portion of a humidifier according to Embodiment 6 of the present invention.

FIG. 11 is a cross-sectional view of the side of a part of the humidifier according to Embodiment 6 of the present invention.

In Embodiment 6, the diffusing member 4 is a wave-shaped material having crests and troughs in the direction in which air flows, and to match the shape of the diffusing member 4, the humidifying member 5 has a wave-shaped top surface. To obtain the wave-shaped diffusing member 4, the diffusing member 4 having a rectangular shape may be bent. Moreover, the bottom surfaces of an upper portion upwind side fixing member 6 and an upper portion downwind side fixing member 7 (surfaces in contact with the diffusing member 4) are shaped so as to fit into the wave-shaped diffusing member 4. As with Embodiment 1, pressure is applied from a casing 12 in the vertical direction.

The procedures of a humidifying operation and a drying operation are the same as described in Embodiment 1.

Effects of Embodiment 6

In the humidifier according to Embodiment 6, the diffusing member 4 is wave shaped, and to match the shape of the diffusing member 4, the humidifying member 5 has a wave-shaped top surface. Moreover, the bottom surfaces of the upper portion upwind side fixing member 6 and the upper portion downwind side fixing member 7 are shaped so as to fit into the wave-shaped diffusing member 4. Pressure is applied from the casing 12 in the vertical direction. Thus, as with Embodiment 1, even if the whole humidifier cannot keep a horizontal state and is inclined, water can be evenly supplied to the entire humidifying member. Accordingly, high humidification performance can be obtained.

Embodiment 7

The structure of a humidifier according to Embodiment 7 is basically the same as that of the humidifier according to Embodiment 5 illustrated in FIG. 10. However, the shape of a humidifying member 5 is different from that in Embodiment 5. The following mainly describes differences between the humidifier according to Embodiment 7 and the humidifier according to Embodiment 5.

Figure 12:
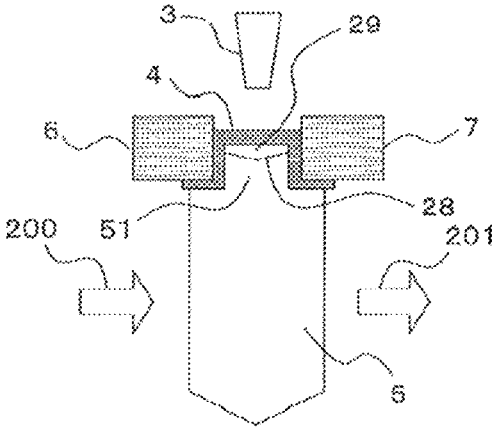
FIG. 12 is a cross-sectional view of the side of a portion of a humidifier according to Embodiment 7 of the present invention.

FIG. 12 is a cross-sectional view of the side of a part of the humidifier according to Embodiment 7 of the present invention.

An inverted triangular-shaped notch 28 is provided at the top surface of a projection 51 of the humidifying member 5 in Embodiment 7, and a gap 29 is formed between the top surface of the projection 51 and the diffusing member 4. The gap 29 is wider at a portion directly below a nozzle 3. As the gap 29 increases, water supply becomes difficult.

A water flow is likely to be deflected at the portion directly below the nozzle 3. Thus, water supply to the portion directly below the nozzle 3 is decreased by increasing the gap 29 at the portion directly below the nozzle 3. This facilitates diffusion of water in the area around the portion directly below the nozzle 3, and allows water to be evenly diffused as a whole.

The procedures of a humidifying operation and a drying operation are the same as described in Embodiment 5.

Effects of Embodiment 7

In the humidifier according to Embodiment 7, the top surface of the projection 51 of the humidifying member 5 has the inverted triangular-shaped notch 28, and the gap 29 is formed between the top surface of the projection 51 and the diffusing member 4. Thus, as with Embodiment 1, even if the whole humidifier cannot keep a horizontal state and is inclined, water can be evenly supplied to the entire humidifying member. Accordingly, high humidification performance can be obtained.

Embodiment 8

The whole structure of a humidifier according to Embodiment 8 is the same as described in Embodiment 1. Embodiment 8 specifies a relation of the pore size of the diffusing member 4 and the pore size of the humidifying member 5. The pore size of the diffusing member 4 is larger than that of the humidifying member 5. That is, pores having a smaller pore size than the pores of the humidifying member 5 is used in the diffusing member 4, and pores having a larger pore size than the pores of the diffusing member 4 is used in the humidifying member 5.

Figure 13:
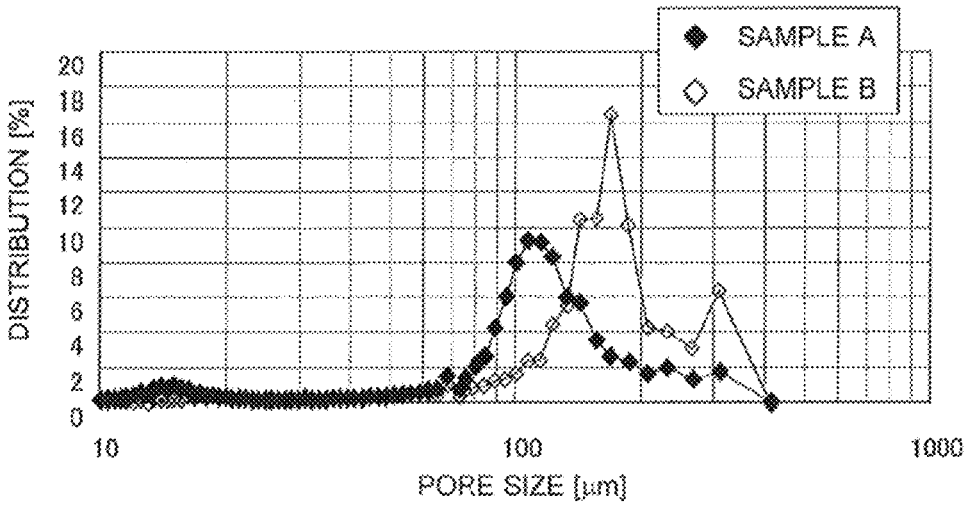
FIG. 13 shows results of evaluating pore size distribution for two kinds of porous metals by a mercury press-in method.

FIG. 13 shows results of evaluating pore size distribution for two kinds of porous metals by a mercury press-in method. A sample A and a sample B are made of nickel. However, the sample A and the sample B are manufactured in different methods so that the pore size distribution for the sample A and the pore size distribution for the sample B are different. As is clear from FIG. 13, the sample A has a smaller pore size as a whole, and the peak indicates a pore size of around 110 μm. Meanwhile, the sample B has a larger pore size as a whole, and the peak indicates a pore size of around 180 μm.

To select the diffusing member 4 most suitable for diffusing water in the plane direction, diffusion performance needs to be quantified. The diffusion performance was measured using the following method.

Figure 14:
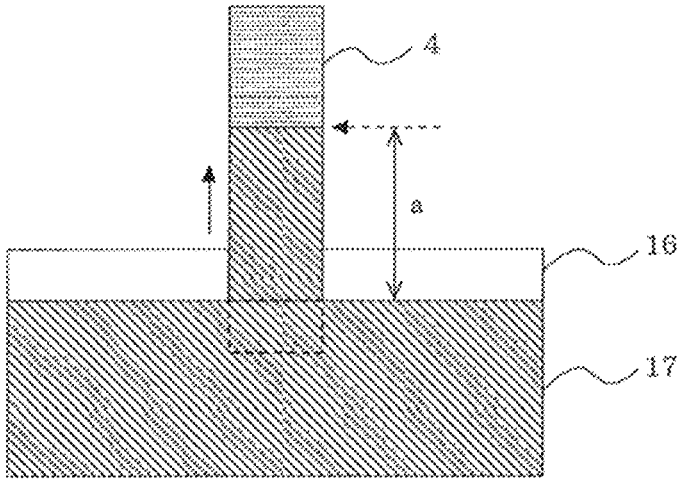
FIG. 14 is a figure for explaining an overview of a method of measuring diffusion performance of a diffusing member 4 in a humidifier according to Embodiment 8 of the present invention.

FIG. 14 is a figure for explaining an overview of a method of measuring diffusion performance of the diffusing member 4 in the humidifier according to Embodiment 8 of the present invention. The diffusing member 4 is cut into a rectangular shape of 175 mm×30 mm×1 mm. Ion exchanged water 17 is contained in a container 16, and a 10-mm lower end portion of the diffusing member 4 having the rectangular shape is soaked in the ion exchanged water 17. The inside of the diffusing member 4 is porous. Thus, because of capillarity, the ion exchanged water 17 is infiltrated into the inside of the diffusing member 4, and the ion exchanged water 17 ascends. Since a steady state starts five minutes after the initiation of the test, an ascent distance a corresponding to the ascent distance of the ion exchanged water 17 is measured. Here, the capillarity and gravity applied to the ion exchanged water 17 infiltrated into the inside of the diffusing member 4 are balanced.

The higher the capillarity, the higher the diffusion performance for the water inside the diffusing member. As the diffusion performance is higher, the ascent distance a indicates a larger value. Thus, the diffusion performance can be quantified. The values of the ascent distances a for the sample A and the sample B illustrated in FIG. 4 are 80 mm and 60 mm, respectively. This means that the sample A has a higher value and demonstrates higher diffusion performance than the sample B. Accordingly, as the diffusing member 4, the sample A is determined to be more suitable than the sample B.

A relation of the diffusion performance of the diffusing member 4 and the diffusion performance of the humidifying member 5 is described below. When the value of the ascent distance a for the diffusing member 4 is a1 and the value of the ascent distance a for the humidifying member 5 is a2, the relation is preferably expressed as follows: a1/a2 is 1.3 or more. This is based on the following test results. Diffusion performance was tested using the sample A as the diffusing member 4 and using the sample B as the humidifying member 5. Moreover, diffusion performance was tested using the sample A as the humidifying member 5 and using the sample B as the diffusing member 4. Higher diffusion performance was obtained when the sample A was used as the diffusing member 4 and the sample B was used as the humidifying member 5 (i.e., a1/a2=80/60=1.33).

Factors that affect the diffusion performance include the material of the diffusing member 4 and the degree of a hydrophilic property of the surface, in addition to the pore size distribution. In general, higher diffusion performance is demonstrated when a metal material is used than when a resin material is used, and the higher the hydrophilic property of the surface, the higher the diffusion performance.

The following describes test results showing effects of the humidifying operation of the humidifier according to Embodiment 8 of the present invention.

In tests, the structure illustrated in FIGS. 1 and 2 was applied to the humidifier, and humidifying operations were performed using the sample A and the sample B illustrated in FIG. 13 as the diffusing member 4 and the humidifying member 5. It should be noted that the temperature and relative humidity of air on the upwind side of the humidifying member 5 were set to 20 degrees C. and 50%, respectively. The temperature and relative humidity of the air on the downwind side of the humidifying member 5 were measured with a hygrothermograph (HC2-S of ROTRONIC), and a change in absolute humidity was obtained. Then, humidification performance (unit of the value is $mL/h/m^2$) per unit surface area of a porous metal body was calculated. The test results shown by Table 2 below were obtained.

When the sample A was used as both the diffusing member 4 and the humidifying member 5, humidification performance was 550 ($mL/h/m^2$). When the sample A was used as the diffusing member 4 and the sample B was used as the humidifying member 5, humidification performance was 650 (mL/h/m$^2$). Thus, when the sample B was used as the diffusing member 5, higher humidification performance was obtained.

When the sample B was used as the diffusing member 4 and the sample A was used as the humidifying member 5, humidification performance was 460 (mL/h/m$^2$). When the sample B was used as both the diffusing member 4 and the humidifying member 5, humidification performance was 540 (mL/h/m$^2$).

These test results show that the highest humidification performance can be obtained when the sample A having a small pore size is used as the diffusing member 4 and the sample B having a large pore size is used as the humidifying member 5. That is, by using a material having a small pore size as the diffusing member 4, the diffusing member 4 can efficiently diffuse water in a horizontal direction, and by using a material having a large pore size as the humidifying member 5, the humidifying member 5 can efficiently humidify air. By employing this structure, the highest humidification performance can be obtained.

TABLE 2

List of Humidification Performance (unit: mL/h/m$^2$)

| | Diffusing Material 4 | |
|---|---|---|
| Humidifying Material 5 | Sample A | Sample B |
| Sample A | 550 | 460 |
| Sample B | 650 | 540 |

Effects of Embodiment 8

In the humidifier according to Embodiment 8, the diffusing member 4 having higher performance of diffusing water in the plane direction than the humidifying member 5 is in contact with and fixed to the humidifying member 5 so as to cover the top surface of the humidifying member 5, and water drops on the diffusing member 4 spaced apart from one another from the water supply portion. Thus, the water supplied to the diffusing member 4 is diffused in the plane direction of the diffusing member 4 at a high speed. Accordingly, even if the humidifier cannot keep a horizontal state and is inclined, the water can be evenly supplied to the humidifying member 5. Accordingly, high humidification performance can be obtained.

Moreover, by using a material having a smaller pore size than the material of the humidifying member 5, as the diffusing member 4, water can be efficiently diffused in the plane direction (horizontal direction) inside the diffusing member 4. By using a material having a larger pore size than the material of the diffusing member 4, as the humidifying member 5, air can be efficiently humidified in the humidifying member 5. Accordingly, by employing this structure, the highest humidification performance can be obtained.

Embodiment 9

Embodiment 9 is different from Embodiment 1 in the structure of a diffusing member 4. The following mainly describes differences between a humidifier according to Embodiment 9 and the humidifier according to Embodiment 1.

Figure 15:
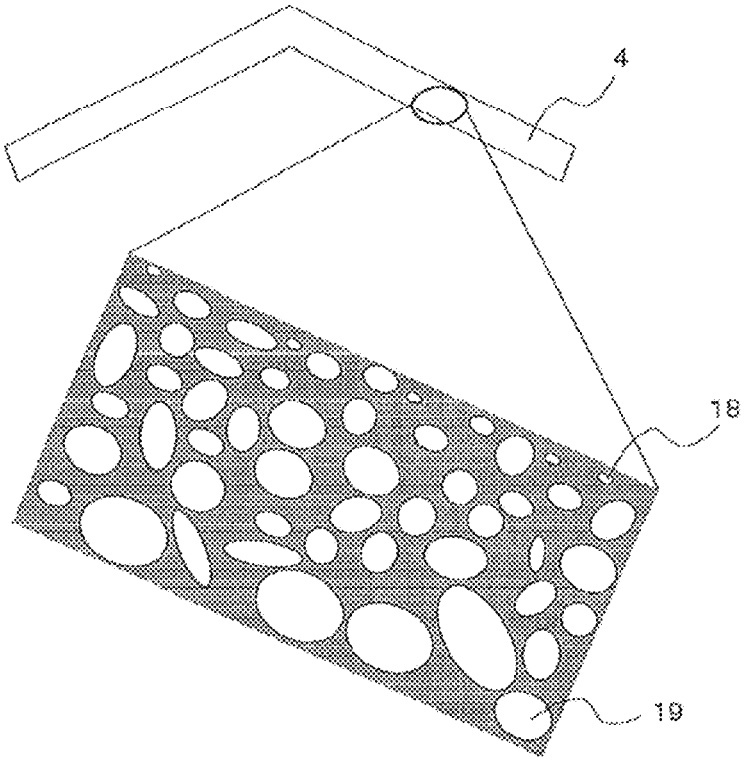
FIG. 15 illustrates a structure of a diffusing member 4 of a humidifier according to Embodiment 9 of the present invention.

FIG. 15 illustrates a structure of the diffusing member 4 of the humidifier according to Embodiment 9 of the present invention. In Embodiment 1, as FIG. 13 illustrates, in the diffusing member 4, pores of different pore sizes are randomly distributed both in the vertical direction and in the plane direction. In Embodiment 9, as FIG. 15 illustrates, in a state in which the diffusing member 4 is provided on the top surface of a humidifying member 5, small size pores 18 are provided near the top surface of the diffusing member 4, and large size pores 19 are provided near the bottom surface of the diffusing member 4.

The following describes a method of manufacturing the diffusing member 4 having such a structure. For instance, bubbles are injected into a slurry containing a solvent and metal powders serving as a raw material of a porous metal. Here, samples having different mixture ratios of the metal powders and the bubbles are prepared. The slurry is then stacked and formed into a desired shape. After sintering the slurry, the porous metal can be manufactured. Alternatively, a porous metal can be manufactured by making metal powders serving as a raw material of the porous metal adhere to a commercial sponge porous resin having different density in the vertical direction and serving as a base material, and then decomposing and eliminating the resin material by high-temperature calcination.

As described in Embodiment 8, when the same hydrophilic treatment is performed on the diffusing member 4 made of the same material, the diffusing member 4 having a smaller pore size demonstrates higher diffusion performance. Thus, a smaller pore size is more suitable when diffusing humidifying water in the plane direction inside the diffusing member 4. However, humidification performance is higher at a large pore size than at a small pore size. As FIG. 1 illustrates, the bottom surface of the diffusing member 4 is in contact with air to be humidified. Thus, higher humidification performance can be demonstrated by providing pores having a large pore size near the bottom surface of the diffusing member 4.

Moreover, porosity may vary instead of the pore size. That is, the porosity may be low near the top surface of the diffusing member 4, and the porosity may be high near the bottom surface of the diffusing member 4. One-to-one correspondence between the pore size and porosity is not necessarily established. However, in general, the porosity is controlled when manufacturing the diffusing member 4. Thus, after all, the pore size varies depending on the porosity. That is, for low porosity, the pore size tends to be small, and for high porosity, the pore size tends to be large. Accordingly, the pore volume rate may be lower at the top surface side of the diffusing member 4 than at the bottom surface side of the diffusing member 4. The pore volume rate may be higher at the bottom surface side of the diffusing member 4 than at the top surface side of the diffusing member 4.

The procedure of a humidifying operation of the humidifier is the same as described in Embodiment 1. However, since the large size pores 19 are provided near the bottom surface of the diffusing member 4 in contact with air, higher humidification performance can be obtained in Embodiment 9.

The procedure of a drying operation is the same as described in Embodiment 1.

Effects of Embodiment 9

In the humidifier according to Embodiment 9, the small size pores 18 are provided near the top surface of the diffusing member 4, and the large size pores 19 are provided near the bottom surface of the diffusing member 4. Thus, as with Embodiment 1, even if the whole humidifier cannot keep a horizontal state and is inclined, water can be evenly supplied to the entire humidifying member. Accordingly, high humidification performance can be obtained. Moreover, the humidification performance is improved by providing the large size pores on the bottom surface side of the diffusing member 4.

Embodiment 10

The structure of a diffusing member 4 is the same as described in Embodiment 9. However, manufacturing methods in Embodiments 9 and 10 are different. The following mainly describes differences between a humidifier according to Embodiment 10 and the humidifier according to Embodiment 9. The structure of the humidifier according to Embodiment 10 is the same as described in Embodiment 1 illustrated in FIGS. 1 and 2.

Figure 16:
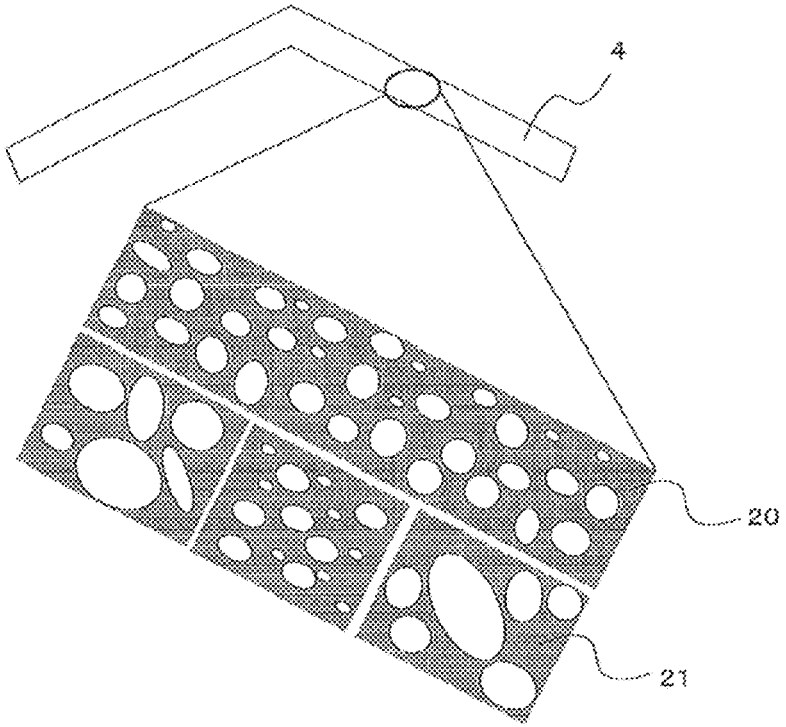
FIG. 16 illustrates a structure of a diffusing member 4 of a humidifier according to Embodiment 10 of the present invention.

FIG. 16 illustrates a structure of the diffusing member 4 of the humidifier according to Embodiment 10 of the present invention.

As FIG. 16 illustrates, the diffusing member 4 is made by overlapping and bonding a porous material 20 and a porous material 21 having different pore volume rates. The porous material 20 having a low pore volume rate servers as the upper portion of the diffusing member 4, and the porous material 21 having a high pore volume rate serves the lower portion of the diffusing member 4. The porous material 20 and the porous material 21 come in contact and are uniformly formed without a gap by heating and welding the overlapped porous material 20 and porous material 21 or by applying pressure to the overlapped porous material 20 and porous material 21. If there is a gap between the porous material 20 and the porous material 21, deflection of water flow is caused and water cannot be evenly diffused in the entire lower portion of the diffusing member 4.

As an example of the structure of the diffusing member 4, the sample A illustrated in FIG. 13 is used as the porous material 20, and the sample B illustrated in FIG. 13 is used as the porous material 21. Not the two layers but three or more layers may be overlapped, and a pore size may gradually become larger (pore volume rate may gradually become higher) from the top surface side of the diffusing member 4 toward the bottom surface side of the diffusing member 4. In any case, as with Embodiment 2, small size pores are provided near the top surface of the porous material, and large size pores are provided near the bottom surface of the porous material. It should be noted that the porous material 20 and the porous material 21 may be joined together.

The operation of the humidifier is the same as described in Embodiment 1.

Effects of Embodiment 10

In the humidifier according to Embodiment 10, the porous material 20 and the porous material 21 are bonded together so that the porous material 20 having a small pore size is provided on the top surface side of the diffusing member 4 and the porous material 21 having a large pore size is provided on the bottom surface side of the diffusing member 4. Thus, as with Embodiment 1, even if the whole humidifier cannot keep a horizontal state and is inclined, water can be evenly supplied to the entire humidifying member. Accordingly, high humidification performance can be obtained. Moreover, the humidification performance is improved by providing large size pores on the bottom surface side of the diffusing member 4.

Embodiment 11

Embodiment 11 is different from Embodiment 10 in the structure of a diffusing member 4. The following mainly describes differences between a humidifier according to Embodiment 11 and the humidifier according to Embodiment 10. The structure of the humidifier according to Embodiment 11 is the same as described in Embodiment 2 illustrated in FIG. 5.

Figure 17:
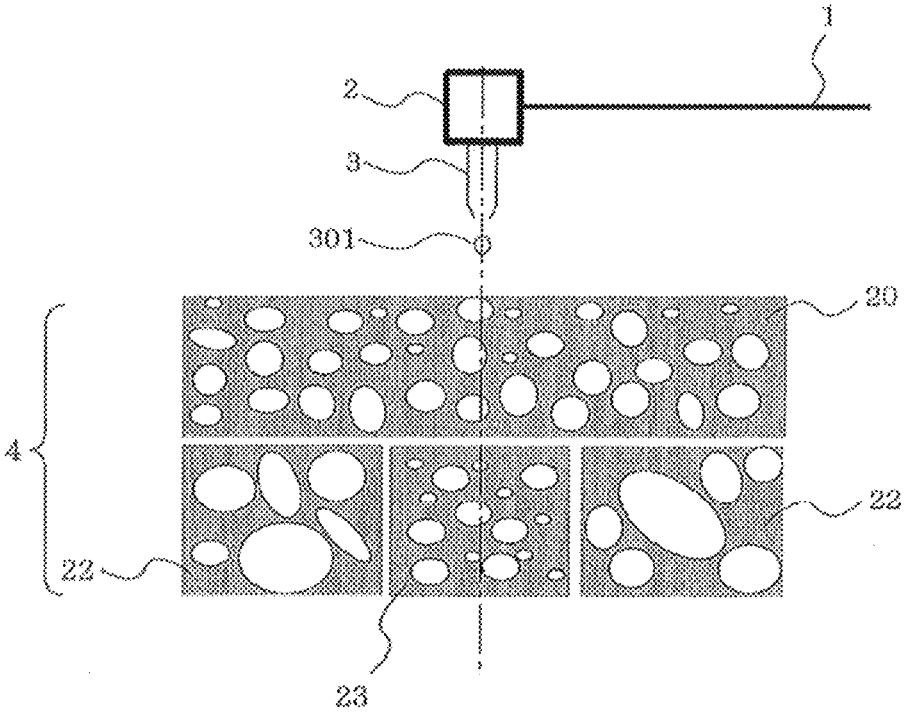
FIG. 17 illustrates a water supply portion and a cross section of a diffusing member 4 of a humidifier according to Embodiment 11 of the present invention.
Figure 18:
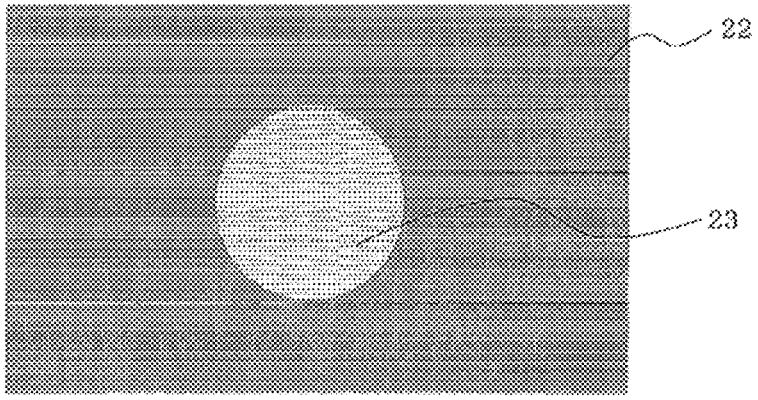
FIG. 18 illustrates a structure of the diffusing member 4 in FIG. 17 when viewed from the bottom side of the diffusing member 4.

FIG. 17 illustrates a water supply portion and a cross section of the diffusing member 4 of the humidifier according to Embodiment 11 of the present invention. FIG. 18 illustrates a structure of the diffusing member 4 in FIG. 17 when viewed from the bottom side of the diffusing member 4.

In the diffusing member 4, water droplets 301 from a nozzle 3 are likely to concentrate at a portion directly below the nozzle 3. In Embodiment 10 illustrated in FIG. 16, the pore size of the porous material 20 is smaller than that of the porous material 21, thereby Improving the diffusion performance. This suppresses the concentration of the water droplets 301 at the portion directly below the nozzle 3. However, further improvement is required.

As with Embodiment 3, a porous material 20 having a small pore size is provided on the top surface side of the diffusing member 4 in Embodiment 11. As a difference point, on the bottom surface side of the diffusing member 4, a part of a porous material 22 having a large pore size is removed so as to make, for example, a circular hole, and a porous material 23 having a smaller pore size than the porous material 22 is inserted into the hole. The center position of the porous material 23 is substantially the same as the central axis of the nozzle 3 in the vertical direction.

In this structure, the water droplets 301 supplied from the nozzle 3 are diffused in the porous material 20, and are then supplied to the porous material 22 and the porous material 23 below the porous material 20. The porous material 23 directly below the nozzle 3 has a smaller pore size than the porous material 22 around the porous material 23. Thus, water droplets from the porous material 22 are supplied downward faster than water droplets from the porous material 23. Thus, the diffusing member 4 as a whole can more evenly supply the humidifying water to the humidifying member 5.

The operation of the humidifier is the same as described in Embodiment 1.

Effects of Embodiment 11

In the humidifier according to Embodiment 11, the following effects are obtained in addition to effects similar to those obtained in Embodiment 10. The porous material 20 serves as the upper portion of the diffusing member 4, and the porous material 22 serves as the lower portion of the diffusing member 4. At the lower portion of the diffusing member 4, a part of the porous material 22 including a portion directly below the nozzle 3 is replaced by the porous material 23 having a smaller pore size than the porous material 22. Accordingly, in the diffusing member 4, the concentration of the water droplets 301 at the portion directly below the nozzle 3 can be suppressed, and the humidifying water can be more evenly supplied to the humidifying member 5 than Embodiment 10.

Embodiment 12

The humidifiers according to Embodiments 1 to 11 perform a drying operation for drying the humidifying member 5. In Embodiment 12, a diffusing member 4 is also dried. The following mainly describes differences between a humidifier according to Embodiment 12 and the humidifier according to Embodiment 1.

Figure 19:
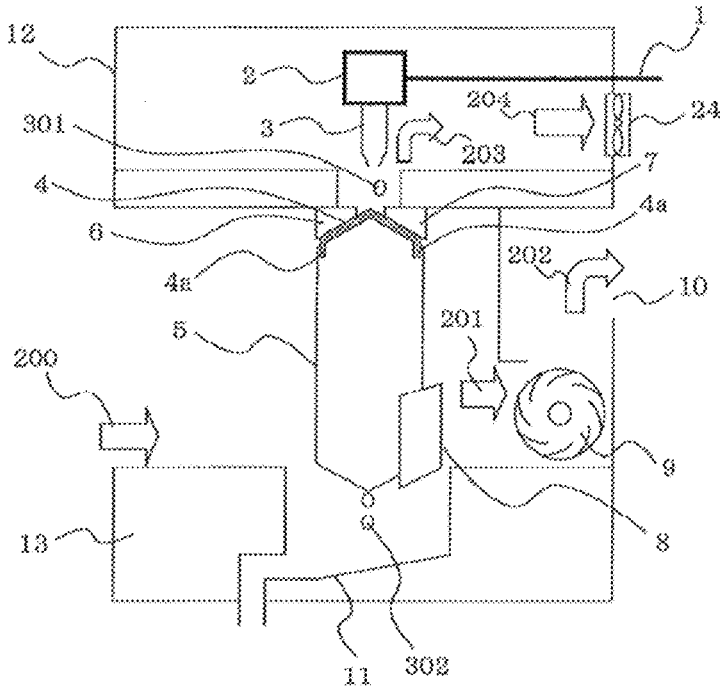
FIG. 19 is a cross-sectional block diagram of a humidifier according to Embodiment 12 of the present invention.

FIG. 19 is a cross-sectional block diagram of the humidifier according to Embodiment 12 of the present invention.

FIG. 19 is different from FIG. 6 in the following point. A casing 12 has an opening, and a fan 24 for passing air through the diffusing member 4 is attached to the casing 12 so as to cover the opening. The air outlet of the fan 24 may be connected to an air outlet 10, or as FIG. 19 illustrates, air may be discharged to the outside of the humidifier.

The procedure of a humidifying operation of the humidifier is the same as described in Embodiment 1.

The following describes differences from Embodiment 1 in the procedure of a drying operation of the humidifier.

As described in Embodiment 1, after performing the humidifying operation for a predetermined period, the humidifier performs a drying operation in which water is stopped from dropping from a nozzle 3 and a fan 9 is caused to continue to operate for a certain time and send wind to the humidifying member 5. In the drying operation in Embodiment 12, the fan 24 is also caused to operate. The operation of the fan 24 allows air to flow in an arrow 203 direction and to flow in an arrow 204 direction via the diffusing member 4, and the air is then discharged through the fan 24. By drying the diffusing member 4 and the humidifying member 5 through this drying operation, the growth of microorganisms such as bacteria or fungi is suppressed.

Effects of Embodiment 12

In Embodiment 12, the following effects are obtained in addition to effects similar to those obtained in Embodiments 1 to 11. That is, in addition to the fan 9 for passing air through the diffusing member 5, the fan 24 mainly for passing air through the diffusing member 4 during the drying operation is provided. Thus, the diffusing member 4 is speedily dried during the drying operation, thereby suppressing the growth of microorganisms such as bacteria or fungi.

Embodiment 13

In Embodiment 13, a heater is added to the humidifier according to Embodiment 12. The following mainly describes differences between a humidifier according to Embodiment 13 and the humidifier according to Embodiment 12.

Figure 20:
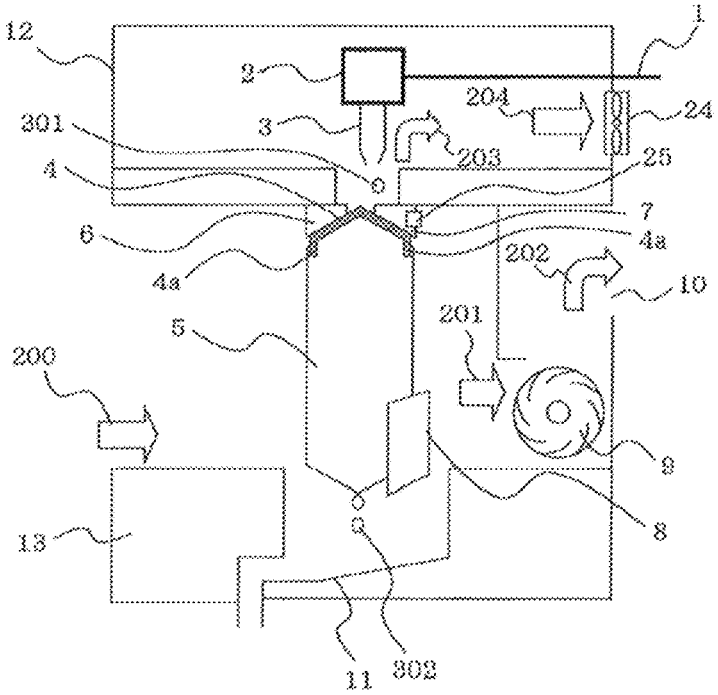
FIG. 20 is a cross-sectional block diagram of a humidifier according to Embodiment 13 of the present invention.

FIG. 20 is a cross-sectional block diagram of the humidifier according to Embodiment 13 of the present invention.

FIG. 20 is different from FIG. 19 in that a heater 25 serving as a heating unit is provided in a diffusing member 4. The heater 25 heats the diffusing member 4. The heater 25 may be any component as long as it generates heat. For instance, the heater 25 may be a nichrome wire, a positive temperature coefficient (PTC) heater, a heat pump, or a Peltier element. In this structure, the diffusing member 4 can be heated by heat generated by the heater 25.

During the drying operation described in Embodiment 12, the humidifier according to Embodiment 13 further applies a voltage to the heater 25 and heats the diffusing member 4, thereby improving the efficiency of the drying operation. The other operation of the humidifier is the same as described in Embodiment 12.

Figure 21:
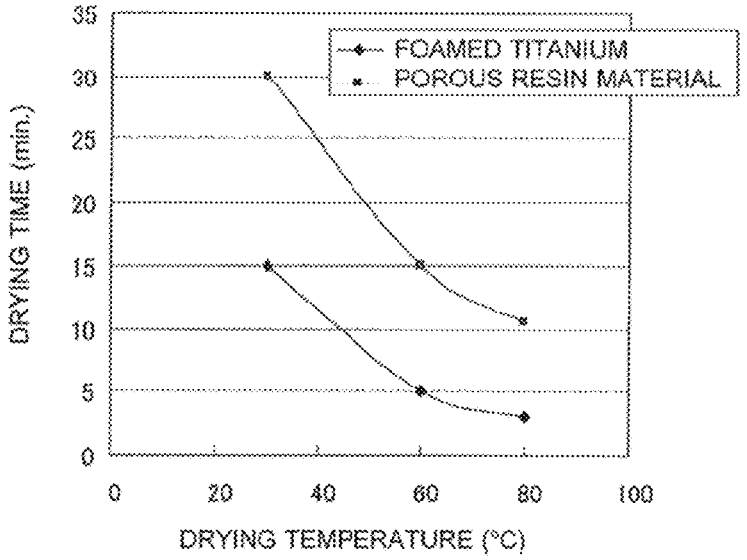
FIG. 21 illustrates relationships between a drying temperature and a drying time for different materials.

FIG. 21 illustrates relationships between a drying temperature and a drying time for different materials. The horizontal axis represents the drying temperature (degree C.), and the vertical axis represents the drying time (minute). FIG. 21 illustrates (i) a relationship between the drying temperature and the drying time for foamed titanium as an example of a foamed metal and (ii) a relationship between the drying temperature and the drying time for a porous resin material as an example of a resin material.

A temperature of around 60 to 80 degrees C. is appropriate in consideration of reduction of the drying time and energy efficiency. Since the foamed metal has higher heat conductivity and a shorter drying time than the resin material, the foamed metal is hygienically excellent.

Figure 22:
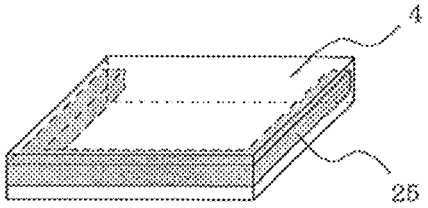
FIG. 22 is a perspective view showing an example of positioning of a heater 25 of the humidifier according to Embodiment 13 of the present invention.

FIG. 22 is a perspective view showing an example of positioning of the heater 25 of the humidifier according to Embodiment 13 of the present invention.

As FIG. 13 illustrates, the heater 25 extends along a portion of the periphery of the diffusing member 4. This shape of the heater 25 is employed as it can realize higher efficiency of drying without making the heater 25 hinder the diffusion of water. Alternatively, a ring-shaped heater extending along the entire periphery of the diffusing member 4 may be used. This can save the drying time and speed up the drying operation.

Effects of Embodiment 13

In Embodiment 13, effects similar to those obtained in Embodiment 12 are obtained. In addition, by attaching the heater 25 to the humidifier and by operating the heater 25 during the drying operation, the diffusing member 4 is speedily dried and the growth of microorganisms such as bacteria or fungi is suppressed.

Embodiment 14

Embodiment 14 relates to an air-conditioning apparatus including one of the humidifiers according to Embodiments 1 to 13. The following describes the air-conditioning apparatus including the humidifier according to Embodiment 14 with reference to drawings.

(Structure of Humidification Device)

Figure 23:
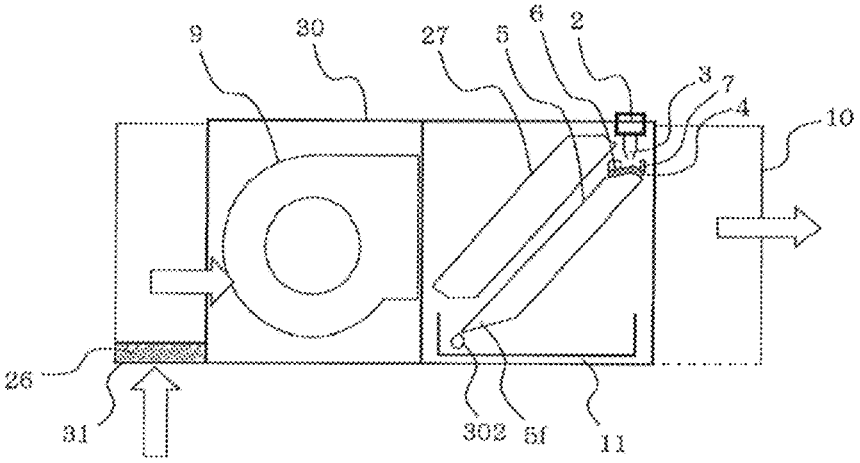
FIG. 23 is a cross-sectional block diagram of an air-conditioning apparatus according to Embodiment 14 of the present invention.

FIG. 23 is a cross-sectional block diagram of the air-conditioning apparatus according to Embodiment 14 of the present invention. In FIG. 23, the outline arrows denote directions in which air is sent by a fan 9.

In a casing 30 of the air-conditioning apparatus according to Embodiment 14, a heat exchanger 27 and one of the humidifiers according to Embodiments 1 to 13 are provided. The diffusing member 4 and the humidifying member 5 of the humidifier are below the heat exchanger 27. A filter 26 is provided at an air inlet 31 of the casing 30, and removes dust from the flow of air sucked by the air inlet 31. It should be noted that the casing 30 also functions as the casing 12 and the casing 13 of the humidifier.

As with Embodiment 1, flat-shaped materials arranged in parallel constitute the humidifying member 5. The heat exchanger 27 is placed in the casing 30 so that the upper side of the heat exchanger 27 is inclined toward the downwind side of the air flow. The humidifying member 5 extends along the shape of the heat exchanger 27 inclined as above, and the humidifying member 5 has a mountain-like top surface and a substantially rhombic shape in side view. The supply part 2 and the nozzle 3 are provided above the diffusing member 4, enabling the supply of humidifying water. Portions of the diffusing member 4 are pressed and bonded to the humidifying member 5 by the upper portion upwind side fixing member 6 and the upper portion downwind side fixing member 7 applying pressure downward.

(Operation of Humidification Device)

The following describes an operation of the air-conditioning apparatus including the humidifier according to Embodiment 14 with reference to FIG. 23.

The air-conditioning apparatus including the humidifier according to Embodiment 14 has a heating and cooling operation function as well as a humidifying operation function, and performs the air humidifying operation and the heating and cooling operation concurrently or selectively, depending on the temperature and humidity of air required at the outlet.

As with Embodiment 1, during the humidifying operation, water stored in the supply part 2 is supplied to the nozzle 3 as humidifying water. The humidifying water supplied to the nozzle 3 drops from the end of the nozzle 3, that is, from above the diffusing member 4, toward the top of the diffusing member 4. Thus, the humidifying water is supplied to the humidifying member 5. The humidifying water passes through the cavities 15 (see FIG. 3) of the diffusing member 4 and is evenly diffused in the entire humidifying member 5 by the capillarity of the diffusing member 4 and the gravity of the humidifying water. This allows the humidifying member 5 to retain a certain amount of water.

When the fan 9 starts operating, air sucked by the air inlet 31 flows toward the air outlet 10 (the air flows from the left side of FIGS. 1 and 23 toward the right side of FIGS. 1 and 23), passes through the humidifying member 5 via the filter 26, the fan 9, and the heat exchanger 27, and is discharged to the outside (indoor space) of the air-conditioning apparatus including the humidifier. The water retained in the humidifying member 5 is evaporated by vapor-liquid contact, that is, by contact with the air caused to flow by the operation of the fan 9. In this manner, the air to be conveyed to the indoor space is humidified.

Surplus water in the humidifying member 5 that has not been used for humidification concentrates at a lower side end portion 5*f*, and seeps from the lower side end portion 5*f* and drops downward. The water seeped and dropped from the humidifying member 5 is received by the drain pan 11 and is discharged to the outside of the humidifier.

Through such a humidifying operation by the humidifier, the humidified air can be supplied to the space to be humidified. The temperature of the air can be changed by heated or cooled refrigerant flowing through the heat exchanger 27. An indoor environment with a desired temperature and humidity can be created by the heating and cooling operation of the heat exchanger 27 and the evaporation of water in the humidifying member 5.

A drying operation of the air-conditioning apparatus including the humidifier is the same as described in Embodiment 1. After performing the humidifying operation for a predetermined period, the air-conditioning apparatus performs a drying operation in which water is stopped from dropping from the nozzle 3 and the fan 9 is caused to continue to send air for a certain time. By drying the humidifying member 5 through this drying operation, the growth of microorganisms such as bacteria or fungi is suppressed. It should be noted that during the drying operation, air may be directly sent, or air may be heated by refrigerant flowing through the heat exchanger 27 and warm air may be sent.

Moreover, if the humidifier according to Embodiment 12 or 13 is employed as the humidifier of the air-conditioning device, the drying operation described in Embodiment 12 or 13 may be performed.

Effects of Embodiment 14

The air-conditioning apparatus including the humidifier according to Embodiment 14 can obtain effects similar to those obtained in Embodiments 1 to 13. Thus, high humidification performance can be obtained.

It should be noted that although Embodiments 1 to 14 are described as different embodiments, a humidifier and an air-conditioning apparatus may be made by appropriately combining characteristic structures of the embodiments. For instance, the diffusing member comb teeth 4*b* in Embodiment 3 illustrated in FIG. 6 and Embodiment 5 illustrated in FIG. 10 may be combined. The diffusing member comb teeth 4*b* may be added to the structure illustrated in FIG. 10. As another example, the triangular roof in Embodiment 1 illustrated in FIG. 1 and Embodiment 7 illustrated in FIG. 12 may be combined. In the structure in FIG. 1, the gap 29 may be provided between the diffusing member 4 and the humidifying member 5 directly below the nozzle 3. Moreover, a modification example applied to a structural component in each embodiment of Embodiments 1 to 14 is also applied to another embodiment having a structural component similar to the above structural component.

REFERENCE SIGNS LIST

1 supply pipe 2 supply part 3 nozzle 4 diffusing material 4*a* flat plate 4*b* diffusing member comb teeth 5 humidifying member 5*a* humidifying member 5*b* humidifying member 5*c* humidifying member upstream portion 5*d* humidifying member center portion 5*e* humidifying member downwind portion 5*f* lower side end portion 6 upper portion upwind side fixing member 7 upper portion downwind side fixing member 8 lower portion fixing member 9 fan 10 air outlet 11 drain pan 12 casing 13 casing 14 metal portion 15 cavity 16 container 17 ion exchanged water 18 small size pore 19 large size pore 20 porous material 21 porous material 22 porous material 23 porous material 24 fan 25 heater 26 filter 27 heat exchanger 28 notch 29 gap 30 casing 31 air inlet 41 top portion 42 side portion 43 bottom portion 51 projection 301 water droplet 302 water droplet

The invention claimed is:

1. A humidifier comprising:

a water supply portion configured to supply water;

a diffusing member having a plate-shape, being provided below the water supply portion, and being configured to diffuse the water supplied from the water supply portion in a plane direction and in a thickness direction;

a humidifying member fixed, with a top surface in contact with the diffusing member, the humidifying member being configured to evaporate the water supplied from the diffusing member via the top surface; and a presser member configured to apply pressure to at least a part of a portion in which the diffusing member and the humidifying member come in contact with each other, the humidifying member being configured to have an upward inclination at an upwind side of the humidifying member, and a downward inclination at a downwind side of the humidifying member, the diffusing member being configured to be in contact with an upper part of the humidifying member.

2. The humidifier of claim 1, wherein the presser member is provided on an upper part of the diffusing member, and wherein the presser member is not located on a portion of the diffusing member directly below the water supply portion.

3. The humidifier of claim 1, wherein the presser member is a fixing member provided between the diffusing member and a casing of the humidifier.

4. The humidifier of claim 1, wherein the diffusing member is inclined downward from a portion directly below the water supply portion.

5. The humidifier of claim 1, wherein a portion of the diffusing member directly below the water supply portion is flat-shaped, and a remaining portion of the diffusing member not including the portion directly below the water supply portion, is inclined downward.

6. The humidifier of claim 1, wherein the diffusing member has a quadrangular pyramid shape or a wave shape.

7. The humidifier of claim 1, wherein the diffusing member comprises a top portion covering a top surface of a projection formed on top of the humidifying member, a side portion covering a side surface of the projection, and a bottom portion covering an upper surface of the humidifying member that is not covered by the top portion and side portion, the side portion being pressed in a horizontal direction by the presser member.

8. The humidifier of claim 1, wherein a gap is formed between the diffusing member and the humidifying member, at a portion directly below the water supply portion.

9. The humidifier of claim 1, wherein a plurality of the humidifying members are arranged in parallel and spaced apart from one another, and an end portion of the diffusing member is toothed and engages with an upper end portion of each of the plurality of the humidifying members, the end portion of the diffusing member extending in a direction perpendicular to a direction in which the plurality of the humidifying members are arranged.

10. The humidifier of claim 1, wherein the diffusing member has a surface processed with a hydrophilic treatment.

11. The humidifier of claim 1, wherein the diffusing member comprises porous material made of foamed metal or foamed ceramic, or comprises metal fibers or ceramic fibers.

12. The humidifier of claim 1, wherein the humidifying member has a three-dimensional meshwork structure with pores, and a pore size of the diffusing member is smaller than a pore size of the humidifying member.

13. The humidifier of claim 1, wherein a pore volume rate at a top surface side of the diffusing member is lower than a pore volume rate at a bottom surface side of the diffusing member.

14. The humidifier of claim 13, wherein a part on the bottom surface side of the diffusing member, including a part directly below the water supply portion, has a lower pore volume rate than a rest of the part on the bottom surface side of the diffusing member.

15. The humidifier of claim 1, wherein the diffusing member comprises a plurality of sub-diffusing members having different pore volume rates and being bonded together and a pore volume rate of the diffusing member increases from a top surface side of the diffusing member toward a bottom surface side of the diffusing member.

16. The humidifier of claim 1, further comprising an air discharging unit configured to pass air through the diffusing member.

17. The humidifier of claim 1, wherein the diffusing member comprises a heating unit.

18. The humidifier of claim 17, wherein the heating unit extends along a portion of a periphery or an entire periphery of the diffusing member.

19. An air-conditioning apparatus comprising the humidifier of claim 1.

* * * * *